US011049642B1

(12) United States Patent
Folker

(10) Patent No.: US 11,049,642 B1
(45) Date of Patent: Jun. 29, 2021

(54) DUAL MAGNETIC COMPONENT WITH THREE CORE PORTIONS

(71) Applicant: UNIVERSAL LIGHTING TECHNOLOGIES, INC., Madison, AL (US)

(72) Inventor: Donald Folker, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 287 days.

(21) Appl. No.: 16/048,879

(22) Filed: Jul. 30, 2018

Related U.S. Application Data

(60) Provisional application No. 62/563,257, filed on Sep. 26, 2017.

(51) Int. Cl.

| | |
|---|---|
| ***H01F 27/26*** | (2006.01) |
| ***H01F 27/24*** | (2006.01) |
| ***H01F 41/02*** | (2006.01) |
| ***H01F 27/32*** | (2006.01) |
| *H01F 27/29* | (2006.01) |

(52) U.S. Cl.
CPC ..... *H01F 27/26* (2013.01); *H01F 27/325* (2013.01); *H01F 41/0206* (2013.01); *H01F 27/29* (2013.01)

(58) Field of Classification Search
CPC ..... H01F 27/26; H01F 27/24
See application file for complete search history.

(56) References Cited

U.S. PATENT DOCUMENTS

| | | | | |
|---|---|---|---|---|
| 4,837,497 | A * | 6/1989 | Leibovich | G05F 3/04 323/247 |
| 8,319,592 | B2 * | 11/2012 | Kawarai | H01F 27/36 336/134 |
| 2002/0158713 | A1 * | 10/2002 | Tomita | H01F 37/00 333/181 |
| 2006/0158303 | A1 * | 7/2006 | Diekmann | H01F 38/085 336/234 |
| 2007/0091519 | A1 * | 4/2007 | Abe | H02J 50/10 361/38 |
| 2010/0026441 | A1 * | 2/2010 | Wedley | H01F 27/30 336/221 |
| 2011/0063065 | A1 * | 3/2011 | Hugues Douglas | H01F 27/38 336/170 |

* cited by examiner

*Primary Examiner* — Elvin G Enad
*Assistant Examiner* — Malcolm Barnes
(74) *Attorney, Agent, or Firm* — Patterson Intellectual Property Law, P.C.; Gary L. Montle; Jerry Turner Sewell

(57) ABSTRACT

A magnetic connector assembly has two independent magnetic components sharing a common core structure. The magnetic assembly includes first and second bobbins, and includes a magnetic core. The first bobbin is positioned perpendicularly to the second bobbin. The magnetic core includes at least two core pieces. In an exemplary embodiment, the magnetic core includes first, second, and third core pieces. The first core piece includes at least a first primary middle leg configured to fit within a passageway of the first bobbin and a first auxiliary middle leg configured to fit within a passageway of the second bobbin. The second core piece includes at least a second primary middle leg configured to fit within the passageway of the first bobbin. The third core piece includes a second auxiliary middle leg configured to fit within the passageway of the second bobbin. The auxiliary legs are perpendicular to the primary legs.

15 Claims, 16 Drawing Sheets

DUAL MAGNETIC COMPONENT WITH THREE CORE PORTIONS

CROSS-REFERENCES TO RELATED APPLICATIONS

This application claims benefit of priority of U.S. Provisional Application No. 62/563,257 filed Sep. 26, 2017, entitled "Dual Magnetic with Three Cores," which is incorporated by reference herein in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present disclosure relates generally to transformers and methods for making transformers. More particularly, the present disclosure relates to magnetic assemblies having multiple independent magnetic components.

BACKGROUND

In a conventional electronic system that includes magnetic components, each magnetic component comprises a respective core, a respective bobbin and a respective winding positioned on the bobbin. For example, FIGS. 1A and 1B illustrate a portion of a conventional printed circuit board 100 having a first magnetic assembly 110 and a second magnetic assembly 112. Each magnetic assembly 110, 112 in FIG. 1 has respective E-shaped core halves. Each magnetic assembly may be a transformer, a choke (or inductor) or another type of magnetic component having a winding and a core.

The first magnetic assembly 110 comprises a bobbin 120A having a first pin rail 122A and a second pin rail 124A. Each pin rail supports a plurality of terminal pins 126A. At least two of the terminal pins are electrically connected to a winding 130A, which is wound about a passageway 132A having a first end 134A and a second end 136A. The first end of the passageway receives a middle leg 142A of a first core half 140A. A first outer leg 144A of the first core half extends along a first side of the bobbin in parallel with the passageway. A second outer leg 146A of the first core half extends along a second side of the bobbin in parallel with the passageway. The second end of the passageway receives a middle leg 152A of a second core half 150A. Respective ends (not shown) of the first middle legs of the first and second core halves are adjacent within the passageway. In certain embodiments, the ends are spaced apart by a selected distance to provide an air gap in the magnetic path formed by the two middle legs. A first outer leg 154A of the second core half extends along the first side of the bobbin in parallel with the passageway. A second outer leg 156A of the second core half extends along the second side of the bobbin in parallel with the passageway. In the illustrated embodiment, the respective ends of the corresponding outer legs along the sides of bobbin abut to form a continuous magnetic path from the middle legs and around the outside of the bobbin.

The second magnetic assembly 112 comprises a bobbin 1208 having a first pin rail 122B and a second pin rail 124B. Each pin rail supports a plurality of terminal pins 1268. At least two of the terminal pins are electrically connected to a winding 1308, which is wound about a passageway 132B having a first end 134B and a second end 136B. The first end of the passageway receives a middle leg 142B of a first core half 140B. A first outer leg 144B of the first core half extends along a first side of the bobbin in parallel with the passageway. A second outer leg 146B of the first core half extends along a second side of the bobbin in parallel with the passageway. The second end of the passageway receives a middle leg 152B of a second core half 150B. Respective ends (not shown) of the first middle legs of the first and second core halves are adjacent within the passageway. In certain embodiments, the ends are spaced apart by a selected distance to provide an air gap in the magnetic path formed by the two middle legs. A first outer leg 154B of the second core half extends along the first side of the bobbin in parallel with the passageway. A second outer leg 156B of the second core half extends along the second side of the bobbin in parallel with the passageway. In the illustrated embodiment, the respective ends of the corresponding outer legs along the sides of bobbin abut to form a continuous magnetic path from the middle legs and around the outside of the bobbin.

As shown in FIGS. 1A and 1B, each of the first magnetic assembly 110 and the second magnetic assembly 112 occupies a respective area on an upper surface 160 of the printed circuit board 100. In addition to the minimum area required to accommodate the nominal peripheral dimensions of the respective magnetic assembly, additional space must be provided between each adjacent magnetic assembly to provide allowance for tolerances in the peripheral dimensions. Furthermore, in order to allow the magnetic assemblies to be automatically positioned on the printed circuit board (e.g., by using pick-and-place equipment), sufficient spaced must be provided between adjacent magnetic assemblies to allow the positioning equipment to engage the sides of the assemblies.

BRIEF SUMMARY

Accordingly, a need exists for a magnetic assembly that combines multiple magnetic components into a single component that can be positioned within a smaller surface area on a printed circuit board than the area occupied by the multiple magnetic components.

One aspect of the embodiments disclosed herein is a connector assembly having two independent magnetic components, which share a common core structure. The magnetic assembly includes first and second bobbins, and includes a magnetic core. The first bobbin is positioned perpendicularly to the second bobbin. The magnetic core includes at least two core pieces. In an exemplary embodiment, the magnetic core includes first, second, and third core pieces. The first core piece includes at least a first primary middle leg that is configured to fit within a passageway of the first bobbin and a first auxiliary middle leg that is configured to fit within a passageway of the second bobbin. The second core piece includes at least a second primary middle leg that is configured to fit within the passageway of the first bobbin. The third core piece includes a second auxiliary middle leg that is configured to fit within the passageway of the second bobbin. The auxiliary middle legs are perpendicular to the primary middle legs.

Another aspect of the embodiments disclosed herein is a magnetic core for use with a primary bobbin and an auxiliary bobbin. Each bobbin has a respective passageway. The magnetic core comprises a first primary core portion, a second primary core portion, and an auxiliary core portion. The first primary core portion has at least a first primary middle leg and a first auxiliary middle leg. The first primary middle leg is configured to engage the passageway of the primary bobbin. The first auxiliary middle leg is positioned perpendicularly to the first primary middle leg and is configured to engage the passageway of the auxiliary bobbin. The second primary core portion has at least a second primary middle leg. The second primary middle leg is configured to engage the passageway of the primary bobbin. The auxiliary core portion has at least a second auxiliary middle leg. The second auxiliary middle leg is configured to engage the passageway of the auxiliary bobbin. The auxiliary core portion is configured to mate with both the first and second primary core portions.

In certain embodiments in accordance with this aspect, the first primary core portion includes a first primary core body, a first primary outer leg, a second primary outer leg, the first primary middle leg, a first auxiliary core body, a first auxiliary outer leg, and the first auxiliary middle leg. The first primary core body of the first primary core portion extends in a first direction between a first end of the first primary core body and a second end of the first primary core body. The first primary core body has an outer surface and an inner surface. The first primary outer leg of the first primary core portion extends perpendicularly from the inner surface of the first primary core body in a second direction. The second direction is perpendicular to the first direction. The first primary outer leg is positioned proximate to the first end of the first primary core body. The first primary outer leg has a first primary outer leg end surface. The second primary outer leg of the first primary core portion extends perpendicularly from the inner surface of the first primary core body in the second direction. The second primary outer leg is positioned proximate to the second end of the first primary core body. The second primary outer leg has a second primary outer leg end surface. The first primary middle leg of the first primary core portion extends perpendicularly from the inner surface of the first primary core body in the second direction. The first primary middle leg is positioned between the first primary outer leg and the second primary outer leg. The first primary middle leg has a first primary middle leg cross-sectional profile that is configured to fit within the passageway of the primary bobbin. The first primary middle leg has a first primary middle leg end surface. The first auxiliary core body of the first primary core portion extends in the second direction between the outer surface of the first primary core body and the second primary outer leg end surface. The first auxiliary core body has an inner surface that faces the first direction. The first auxiliary outer leg of the first primary core portion extends perpendicularly from the inner surface of the first auxiliary core body in the first direction. The first auxiliary outer leg is positioned proximate to the outer surface of the first primary core body. The first auxiliary outer leg has a first auxiliary outer leg end surface. The first auxiliary middle leg of the first primary core portion extends perpendicularly from the inner surface of the first auxiliary core body in the first direction. The first auxiliary middle leg is positioned proximate to the second primary outer leg end surface. The first auxiliary middle leg has a first auxiliary middle leg cross-sectional profile that is configured to fit within the passageway of the auxiliary bobbin. The first auxiliary middle leg has a first auxiliary middle leg end surface.

In certain embodiments in accordance with this aspect, the second primary core portion includes a second primary core body, a third primary outer leg, a fourth primary outer leg, the second primary middle leg, a second auxiliary core body, and a second auxiliary outer leg. The second primary core body of the second primary core portion extends in the first direction between a first end of the second primary core body and a second end of the second primary core body. The second primary core body has an outer surface and an inner surface. The third primary outer leg of the second primary core portion extends perpendicularly from the inner surface of the second primary core body in a third direction. The third direction is parallel to and opposite to the second direction. The third primary outer leg is positioned proximate to the first end of the second primary core body. The third primary outer leg has a third primary outer leg end surface. The third primary outer leg end surface is configured to abut the first primary outer leg end surface of the first primary core portion. The fourth primary outer leg of the second primary core portion extends perpendicularly from the inner surface of the second primary core body in the third direction. The fourth primary outer leg is positioned proximate to the second end of the second primary core body. The fourth primary outer leg has a fourth primary outer leg end surface. The fourth outer leg end surface is configured to abut the second primary outer leg end surface of the first primary core portion. The second primary middle leg of the second primary core portion extends perpendicularly from the inner surface of the second primary core body in the third direction. The second primary middle leg is positioned between the third primary outer leg and the fourth primary outer leg. The second primary middle leg has a second primary middle leg cross-sectional profile that is configured to fit within the passageway of the primary bobbin. The second primary middle leg has a second primary middle leg end surface. The second auxiliary core body of the second primary core portion extends in the third direction between the outer surface of the second primary core body and the fourth primary outer leg end surface. The second auxiliary core body has an inner surface that faces the first direction. The second auxiliary outer leg of the second primary core portion extends perpendicularly from the inner surface of the second auxiliary core body in the first direction. The second auxiliary outer leg is positioned proximate to the outer surface of the second primary core body. The second auxiliary outer leg has a second auxiliary outer leg end surface.

In certain embodiments in accordance with this aspect, the auxiliary core portion includes a third auxiliary core body, a third auxiliary outer leg, a fourth auxiliary outer leg, and the second auxiliary middle leg. The third auxiliary core body of the auxiliary core portion extends in the second direction between a first end of the third auxiliary core body and a second end of the third auxiliary core body. The third auxiliary core body has an outer surface and an inner surface. The third auxiliary outer leg of the auxiliary core portion extends perpendicularly from the inner surface of the third auxiliary core body in a fourth direction. The fourth direction is parallel to and opposite to the first direction. The third auxiliary outer leg is positioned proximate to the first end of the third auxiliary core body. The third auxiliary outer leg has a third auxiliary outer leg end surface. The third auxiliary outer leg end surface is configured to abut the first auxiliary outer leg end surface of the first primary core portion. The fourth auxiliary outer leg of the auxiliary core portion extends perpendicularly from the inner surface of the third auxiliary core body in the fourth direction. The fourth auxiliary outer leg is positioned proximate to the second end of the third auxiliary core body. The fourth auxiliary outer leg has a fourth auxiliary outer leg end surface that is configured to abut the second auxiliary outer leg end surface of the second primary core portion. The second auxiliary middle leg of the auxiliary core portion extends perpendicularly from the inner surface of the second auxiliary core body in the fourth direction. The second auxiliary middle leg is positioned between the third auxiliary outer leg and the fourth auxiliary outer leg. The second auxiliary middle leg has a second auxiliary middle leg cross-sectional profile that is configured to fit within the passageway of the auxiliary bobbin. The second auxiliary middle leg has a second auxiliary middle leg end surface.

In certain embodiments in accordance with this aspect, a first gap is defined between the first primary middle leg end surface of the first primary core portion and the second primary middle leg end surface of the second primary core portion.

In certain embodiments in accordance with this aspect, the first and second primary outer legs have a common first primary length defined between the inner surface of the first primary core body and the first and second primary outer leg end surfaces, respectively. The first primary middle leg has a second primary length defined between the inner surface of the first primary core body and the first primary middle leg end surface. The third and fourth primary outer legs have a common third primary length defined between the inner surface of the second primary core body and the third and fourth primary outer leg end surfaces, respectively. The second primary middle leg has a fourth primary length defined between the inner surface of the second primary core body and the second primary middle leg end surface. The first gap is defined by a sum of: (a) a difference between the common first primary length and the second primary length, and (b) a difference between the common third primary length and the fourth primary length.

In certain embodiments in accordance with this aspect, the second primary length is shorter than the common first primary length. The fourth primary length is shorter than the common third primary length. The common first primary length is longer than the common third primary length by a width of the first auxiliary middle leg of the first primary core portion.

In certain embodiments in accordance with this aspect, a second gap is defined between the first auxiliary middle leg end surface of the first primary core portion and the second auxiliary middle leg end surface of the auxiliary core portion.

In certain embodiments in accordance with this aspect, the first and second auxiliary outer legs have a common first auxiliary length defined between the inner surfaces of the first and second auxiliary core bodies, respectively, and the first and second auxiliary outer leg end surfaces, respectively. The first auxiliary middle leg has a second auxiliary length defined between the inner surface of the first auxiliary core body and the first auxiliary middle leg end surface. The third and fourth auxiliary outer legs have a common third auxiliary length defined between the inner surface of the third auxiliary core body and the third and fourth auxiliary outer leg end surfaces, respectively. The second auxiliary middle leg has a fourth auxiliary length defined between the inner surface of the third auxiliary core body and the second auxiliary middle leg end surface. The second gap is defined by a sum of: (a) a difference between the common first auxiliary length and the second auxiliary length, and (b) a difference between the common third auxiliary length and the fourth auxiliary length.

In certain embodiments in accordance with this aspect, the second auxiliary length is shorter than the common first auxiliary length. The fourth auxiliary length is shorter than the common third auxiliary length.

In certain embodiments in accordance with this aspect, the first and second primary core bodies, the first, second, third, and fourth primary outer legs, and the first and second primary middle legs have a first common height. The first and second auxiliary core bodies, the first, second, third, and fourth auxiliary outer legs, and the first and second auxiliary middle legs have a second common height. The second common height is shorter than the first common height.

Another aspect of the embodiments disclosed herein is a magnetic assembly having two independent magnetic components that share a common core structure. The magnetic assembly comprises a first bobbin, a second bobbin, and a magnetic core assembly. The first bobbin has a first winding that surrounds a first passageway. The first passageway has a first end, a second end, and a first passageway profile. The second bobbin has a second winding that surrounds a second passageway. The second passageway is positioned perpendicularly to the first passageway. The second passageway has a first end, a second end, and a second passageway profile. The magnetic core assembly includes at least a first core piece and a second core piece. At least one of the first and second core pieces has a first middle leg and at least one of the first and second core pieces has a second middle leg. The second middle leg is perpendicular to the first middle leg. The first and second middle legs are configured to engage the first passageway and the second passageway, respectively.

In certain embodiments in accordance with this aspect, each of the first and second middle legs is configured to create a gap, which has a gap distance. Each gap is positioned between the first and second ends of its respective bobbin.

In certain embodiments in accordance with this aspect, the at least two core pieces includes the first core piece, the second core piece, and a third core piece. The first core piece has at least a first primary middle leg and a first auxiliary middle leg. The first primary middle leg is configured to engage the first end of the first passageway. The first auxiliary middle leg is positioned perpendicularly to the first primary middle leg and is configured to engage the first end of the passageway of the second bobbin. The second core piece has at least a second primary middle leg that is configured to engage the second end of the first passageway of the first bobbin. The third core piece of the magnetic core assembly has at least a second auxiliary middle leg that is configured to engage the second end of the second passageway.

In certain embodiments in accordance with this aspect, the first core piece includes a first primary core body, a first primary outer leg, a second primary outer leg, the first primary middle leg, a first auxiliary core body, a first auxiliary outer leg, and the first auxiliary middle leg. The first primary core body of the first core piece extends in a first direction between a first end of the first primary core body and a second end of the first primary core body. The first primary core body has an outer surface, an inner surface, and a first primary core body cross-sectional area. The first primary outer leg of the first core piece extends perpendicularly from the inner surface of the first primary core body in a second direction. The second direction is perpendicular to the first direction. The first primary outer leg is positioned proximate to the first end of the first primary core body. The first primary outer leg has a first primary outer leg end surface and a first primary outer leg cross-sectional area. The second primary outer leg of the first core piece extends perpendicularly from the inner surface of the first primary core body in the second direction. The second primary outer leg is positioned proximate to the second end of the first primary core body. The second primary outer leg has a second primary outer leg end surface and a second primary outer leg cross-sectional area. The first primary middle leg of the first core piece extends perpendicularly from the inner surface of the first primary core body in the second direction. The first primary middle leg is positioned between the first primary outer leg and the second primary outer leg. The first primary middle leg has a first primary middle leg cross-sectional profile that is configured to fit within the passageway of the first bobbin. The first primary middle leg has a first primary middle leg end surface and a first primary middle leg cross-sectional area. The first auxiliary core body of the first core piece extends in the second direction between the outer surface of the first primary core body and the second primary outer leg end surface. The first auxiliary core body has an inner surface that faces the first direction. The first auxiliary core body has a first auxiliary core body cross-sectional area. The first auxiliary outer leg of the first core piece extends perpendicularly from the inner surface of the first auxiliary core body in the first direction. The first auxiliary outer leg is positioned proximate to the outer surface of the first primary core body. The first auxiliary outer leg has a first auxiliary outer leg end surface and a first auxiliary outer leg cross-sectional area. The first auxiliary middle leg of the first core piece extends perpendicularly from the inner surface of the first auxiliary core body in the first direction. The first auxiliary middle leg is positioned proximate to the second primary outer leg end surface. The first auxiliary middle leg has a first auxiliary middle leg cross-sectional profile that is configured to fit within the passageway of the second bobbin. The first auxiliary middle leg has a first auxiliary middle leg end surface and a first auxiliary middle leg cross-sectional area.

In certain embodiments in accordance with this aspect, the second core piece includes a second primary core body, a third primary outer leg, a fourth primary outer leg, the second primary middle leg, a second auxiliary core body, and a second auxiliary outer leg. The second primary core body of the second core piece extends in the first direction between a first end of the second primary core body and a second end of the second primary core body. The second primary core body has an outer surface, an inner surface, and a second primary core body cross-sectional area. The third primary outer leg of the second core piece extends perpendicularly from the inner surface of the second primary core body in a third direction. The third direction is parallel to and opposite to the second direction. The third primary outer leg is positioned proximate to the first end of the second primary core body. The third primary outer leg has a third primary outer leg end surface that is configured to abut the first primary outer leg end surface of the first core piece. The third primary outer leg has a third primary outer leg cross-sectional area. The fourth primary outer leg of the second core piece extends perpendicularly from the inner surface of the second primary core body in the third direction. The fourth primary outer leg is positioned proximate to the second end of the second primary core body. The fourth primary outer leg has a fourth primary outer leg end surface that is configured to abut the second primary outer leg end surface of the first core piece. The fourth primary outer leg has a fourth primary outer leg cross-sectional area. The second primary middle leg of the second core piece extends perpendicularly from the inner surface of the second primary core body in the third direction. The second primary middle leg is positioned between the third primary outer leg and the fourth primary outer leg, the second primary middle leg has a second primary middle leg cross-sectional profile that is configured to fit within the passageway of the first bobbin. The second primary middle leg has a second primary middle leg end surface and a second primary middle leg cross-sectional area. The second auxiliary core body of the second core piece extends in the third direction between the outer surface of the second primary core body and the fourth primary outer leg end surface. The second auxiliary core body has an inner surface that faces the first direction. The second auxiliary core body has a second auxiliary core body cross-sectional area. The second auxiliary outer leg of the second core piece extends perpendicularly from the inner surface of the second auxiliary core body in the first direction. The second auxiliary outer leg is positioned proximate the outer surface of the second primary core body. The second auxiliary outer leg has a second auxiliary outer leg end surface and a second auxiliary outer leg cross-sectional area.

In certain embodiments in accordance with this aspect, the third core piece includes a third auxiliary core body, a third auxiliary outer leg, a fourth auxiliary outer leg, and the second auxiliary middle leg. The third auxiliary core body of the third core piece extends in the second direction between a first end of the third auxiliary core body and a second end of the third auxiliary core body. The third auxiliary core body has an outer surface, an inner surface, and a third auxiliary core body cross-sectional area. The third auxiliary outer leg of the third core piece extends perpendicularly from the inner surface of the third auxiliary core body in a fourth direction. The fourth direction is parallel to and opposite to the first direction. The third auxiliary outer leg is positioned proximate to the first end of the third auxiliary core body. The third auxiliary outer leg has a third auxiliary outer leg end surface that is configured to abut the first auxiliary outer leg end surface of the first core piece. The third auxiliary outer leg has a third auxiliary outer leg cross-sectional area. The fourth auxiliary outer leg of the third core piece extends perpendicularly from the inner surface of the third auxiliary core body in the fourth direction. The fourth auxiliary outer leg is positioned proximate to the second end of the third auxiliary core body. The fourth auxiliary outer leg has a fourth auxiliary outer leg end surface that is configured to abut the second auxiliary outer leg end surface of the second core piece. The fourth auxiliary outer leg has a fourth auxiliary outer leg cross-sectional area. The second auxiliary middle leg of the third core piece extends perpendicularly from the inner surface of the second auxiliary core body in the fourth direction. The second auxiliary middle leg is positioned between the third auxiliary outer leg and the fourth auxiliary outer leg. The second auxiliary middle leg has a second auxiliary middle leg cross-sectional profile that is configured to fit within the passageway of the second bobbin. The second auxiliary middle leg has a second auxiliary middle leg end surface and a second auxiliary middle leg cross-sectional area.

In certain embodiments in accordance with this aspect, the first primary core body cross-sectional area is at least as great as each of the first primary outer leg cross-sectional area and the second primary outer leg cross-sectional area, respectively. The second primary core body cross-sectional area is at least as great as each of the third primary outer leg cross-sectional area and the fourth primary outer leg cross-sectional area, respectively. The first auxiliary core body cross-sectional area is at least as great as the first auxiliary outer leg cross-sectional area. The second auxiliary core body cross-sectional area is at least as great as the second auxiliary outer leg cross-sectional area. The third auxiliary core body cross-sectional area is at least as great as each of the third auxiliary outer leg cross-sectional area and the fourth auxiliary outer leg cross-sectional area, respectively.

In certain embodiments in accordance with this aspect, the first primary middle leg cross-sectional area is at least as great as a sum of the first primary outer leg cross-sectional area and second primary outer leg cross-sectional area. The second primary middle leg cross-sectional area is at least as great as a sum of the third primary outer leg cross-sectional area and fourth primary outer leg cross-sectional area. The first auxiliary middle leg cross-sectional area is at least as great as a sum of the first auxiliary outer leg cross-sectional area and second auxiliary outer leg cross-sectional area. The second auxiliary middle leg cross-sectional area is at least as great as a sum of the third auxiliary outer leg cross-sectional area and fourth auxiliary outer leg cross-sectional area.

In certain embodiments in accordance with this aspect, a first common height is shared by the first and second primary core bodies, the first, second, third, and fourth primary outer legs, and the first and second primary middle legs. A second common height is shared by the first and second auxiliary core bodies, the first, second, third, and fourth auxiliary outer legs, and the first and second auxiliary middle legs. The first common height is selected to fit within the first passageway and the second common height is selected to fit within the second passageway.

Another aspect of the embodiments disclosed herein is a magnetic assembly having two independent magnetic components sharing a common core structure. The magnetic assembly comprises a first bobbin, a second bobbin, and a magnetic core assembly. The first bobbin has a first winding that surrounds a first passageway. The first passageway has a first end, a second end, and a first passageway profile. The second bobbin has a second winding that surrounds a second passageway. The second passageway is positioned perpendicularly to the first passageway. The second passageway has a first end, a second end, and a second passageway profile. The magnetic core assembly includes a first core piece, a second core piece, and a third core piece. The first core piece includes a first E-core and a first portion of a second E core. The first E-core extends between a first end surface and a second end surface in a first direction. The first E-core has legs that extend in a second direction. The second direction is perpendicular to the first direction. The first portion of the second E-core is integrally connected to the second end surface of the first E-core and has legs that extend in the first direction. The first E-core is configured to interact with the first bobbin and the first portion of the second E-core is configured to interact with the second bobbin. The second core piece includes a third E-core and a second portion of the second E-core. The third E-core extends in the first direction between a first end surface and a second end surface. The third E-core has legs that extend in a third direction. The third direction is parallel to and opposite the second direction. The second portion of the second E-core is integrally connected to the second end surface of the third E-core and has a leg that extend in the first direction. The third E-core is configured to interact with the first bobbin and the second portion of the second E-core is configured to interact with the second bobbin. The third core piece includes a fourth E-core that extends in the second direction between a first end surface and a second end surface. The fourth E-core has legs that extend in a fourth direction. The fourth direction is parallel to and opposite to the first direction. The fourth E-core is configured to interact with the second bobbin.

In certain embodiments in accordance with this aspect, the first E-core includes a middle leg configured to be received through the first end of the passageway of the first bobbin.

In certain embodiments in accordance with this aspect, the first portion of the second E-core includes a middle leg configured to be received through the first end of the passageway of the second bobbin.

In certain embodiments in accordance with this aspect, the third E-core includes a middle leg configured to be received through the second end of the passageway of the first bobbin.

In certain embodiments in accordance with this aspect, the fourth E-core includes a middle leg configured to be received through the second end of the passageway of the second bobbin.

Another aspect of the embodiments disclosed herein is a method of assembling a magnetic assembly having two independent magnetic components, which share a common core structure. The method comprises positioning a first bobbin perpendicularly to a second bobbin. The method further comprises engaging a first core piece with the first bobbin and the second bobbin by (a) positioning a first primary middle leg of the first core piece in a first end of a passageway of the first bobbin, and (b) positioning a first auxiliary middle leg of the first core piece in a first end of a passageway of the second bobbin. The first auxiliary middle leg is perpendicular to the first primary middle leg. The method further comprises engaging a second core piece with the first bobbin by positioning a second primary middle leg of the second core piece in a second end of the passageway of the first bobbin. The method further comprises engaging a third core piece with the second bobbin by positioning a second auxiliary middle leg of the third core piece in a second end of the passageway of the second bobbin.

In certain embodiments in accordance with this aspect, the first core piece further includes a first primary core body, a first primary outer leg, a second primary outer leg, a first auxiliary core body, and a first auxiliary outer leg. The first primary core body of the first core piece extends in a first direction between a first end and a second end. The first primary middle leg extends perpendicularly from the first primary core body in a second direction. The first primary middle leg is positioned midway between the first and second ends of the first primary core body. The first primary outer leg of the first core piece extends in the second direction from the first primary core body proximate to the first end of the first primary core body. In certain embodiments, the first primary outer leg is positioned on a first side of the first bobbin. The second primary outer leg of the first core piece extends in the second direction from the first primary core body proximate to the second end of the first primary core body. In certain embodiments, the second primary outer leg is positioned on a second side of the first bobbin. The first auxiliary core body of the first core piece extends in the second direction between an outer surface of the first primary core body and an end surface of the second primary outer leg. The first auxiliary middle leg extends perpendicularly from the first auxiliary core body in the first direction. The first auxiliary middle leg is aligned with an end surface of the second primary outer leg. The first auxiliary outer leg of the first core piece extends in the first direction from the first auxiliary core body. The first auxiliary outer leg is aligned with the outer surface of the first primary core body. In certain embodiments, the first auxiliary outer leg is positioned on a first side of the second bobbin.

In certain embodiments in accordance with this aspect, the second core piece further includes a second primary core body, a third primary outer leg, a fourth primary outer leg, a second auxiliary core body, and a second auxiliary outer leg. The second primary core body of the second core piece extends in the first direction between a first end and a second end. The second primary middle leg extends perpendicularly from the second primary core body in a third direction. The third direction is parallel to and opposite to the second direction. The second primary middle leg is positioned midway between the first and second ends of the second primary core body. The third primary outer leg of the second core piece extends in the third direction from the second primary core body proximate to the first end of the second primary core body. In certain embodiments, the third primary outer leg is positioned on the first side of the first bobbin and may abut the first primary outer leg. The fourth primary outer leg of the second core piece extends in the third direction from the second primary core body proximate to the second end of the second primary core body. In certain embodiments, the fourth primary outer leg is positioned on the second side of the first bobbin and may abut the second primary outer leg. The second auxiliary core body of the second core piece extends in the third direction between an outer surface of the second primary core body and an end surface of the fourth primary outer leg. In certain embodiments, the first and second auxiliary core bodies abut in line with the end surfaces of the second and fourth primary outer legs, respectively. The second auxiliary outer leg of the second core piece extends in the first direction from the second auxiliary core body. The second auxiliary outer leg is aligned with the outer surface of the second primary core body. In certain embodiments, the second auxiliary outer leg is positioned on a second side of the second bobbin.

In certain embodiments in accordance with this aspect, the third core piece further includes a third auxiliary core body, a third auxiliary outer leg, and a fourth auxiliary outer leg. The third auxiliary core body of the third core piece extends in the second direction between a first end and a second end. The second auxiliary middle leg extends perpendicularly from the third auxiliary core body in a fourth direction. The fourth direction is parallel to and opposite to the first direction. The second auxiliary middle leg is positioned midway between the first and second ends of the third auxiliary core body. The third auxiliary outer leg of the third core piece extends in the fourth direction from the third auxiliary core body proximate to the first end of the third auxiliary core body. In certain embodiments, the third auxiliary outer leg is positioned on the first side of the second bobbin and may abut the first auxiliary outer leg. The fourth auxiliary outer leg of the third core piece extends in the fourth direction from the third auxiliary core body proximate to the second end of the third auxiliary core body. In certain embodiments, the fourth auxiliary outer leg is positioned on the second side of the second bobbin and abuts the second auxiliary outer leg.

DETAILED DESCRIPTION

Figure 1A:
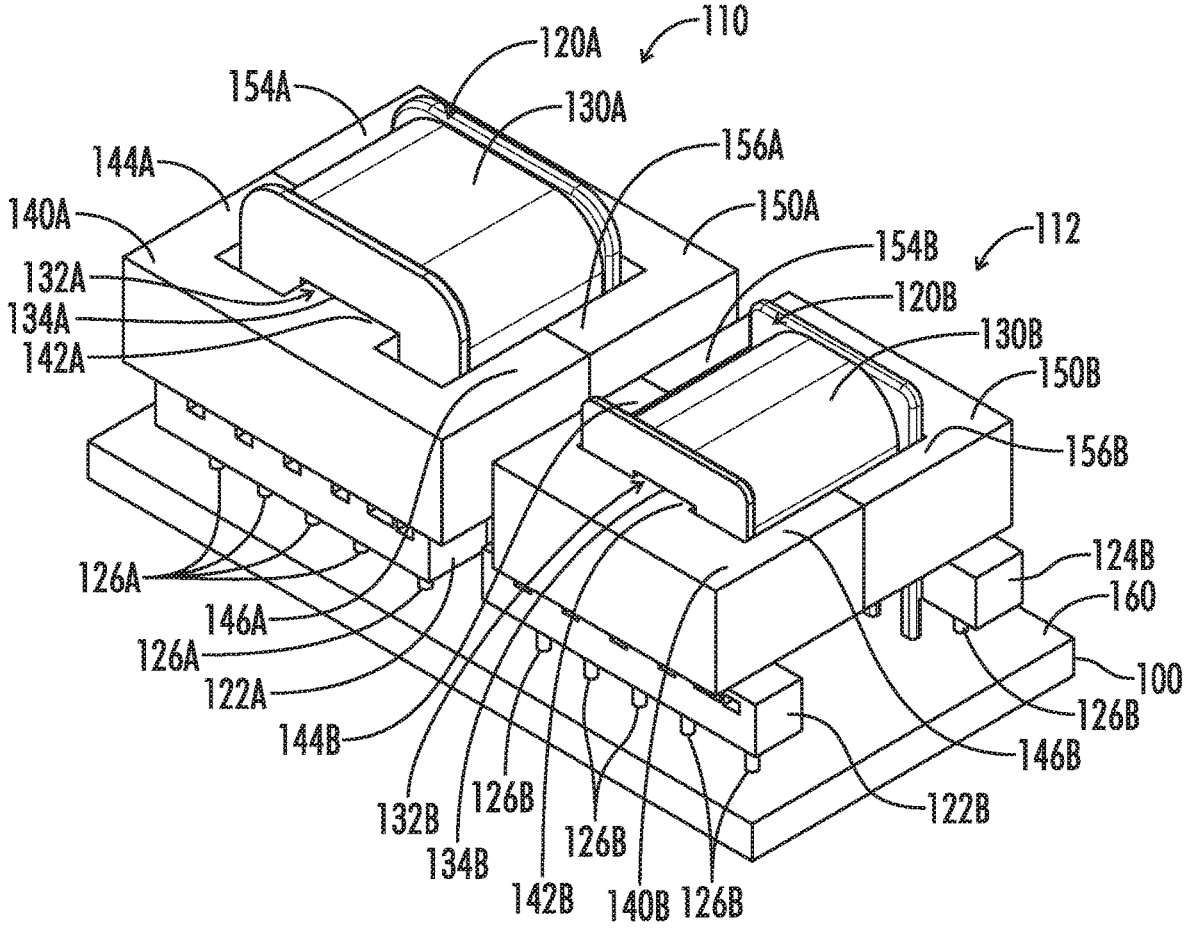
FIG. 1A (PRIOR ART)
FIG. 1A illustrates an upper front perspective view of a conventional printed circuit board with two independent magnetic assemblies positioned thereon, each magnetic assembly having E-shaped cores.

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Reference will now be made in detail to embodiments of the present disclosure, one or more drawings of which are set forth herein. Each drawing is provided by way of explanation of the present disclosure and is not a limitation. It will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

It is intended that the present disclosure covers such modifications and variations as come within the scope of the appended claims and their equivalents. Other objects, features, and aspects of the present disclosure are disclosed in the following detailed description. It is to be understood by one of ordinary skill in the art that the present discussion is a description of exemplary embodiments only and is not intended as limiting the broader aspects of the present disclosure.

FIGS. 2-14 illustrate a single magnetic assembly 200 that includes a first (leftmost as viewed in FIGS. 2 and 3) magnetic component 210 and a second (rightmost as viewed in FIGS. 2 and 3) magnetic component 212. The two magnetic components share a single core structure 214. The single core structure 214 may be referred to as a magnetic core 214 or as a magnetic core assembly 214. Although the first and second magnetic components are structurally coupled together via the single core structure, the two magnetic components function independently of one another. The single magnetic assembly is mounted on a printed circuit board (PCB) 216 in FIG. 2. The magnetic assembly is shown prior to mounting on the PCB in FIGS. 3-14. FIG. 4 illustrates an exploded perspective view of the magnetic assembly of FIG. 3.

An exemplary embodiment of the core structure 214 comprises a first core piece 300, a second core piece 400, and a third core piece 500. The first core piece 300 may be referred to as a first primary core portion 300. The second core piece 400 may be referred to as a second primary core portion 400. The third core piece 500 may be referred to as an auxiliary core portion 500.

Figure 5A:
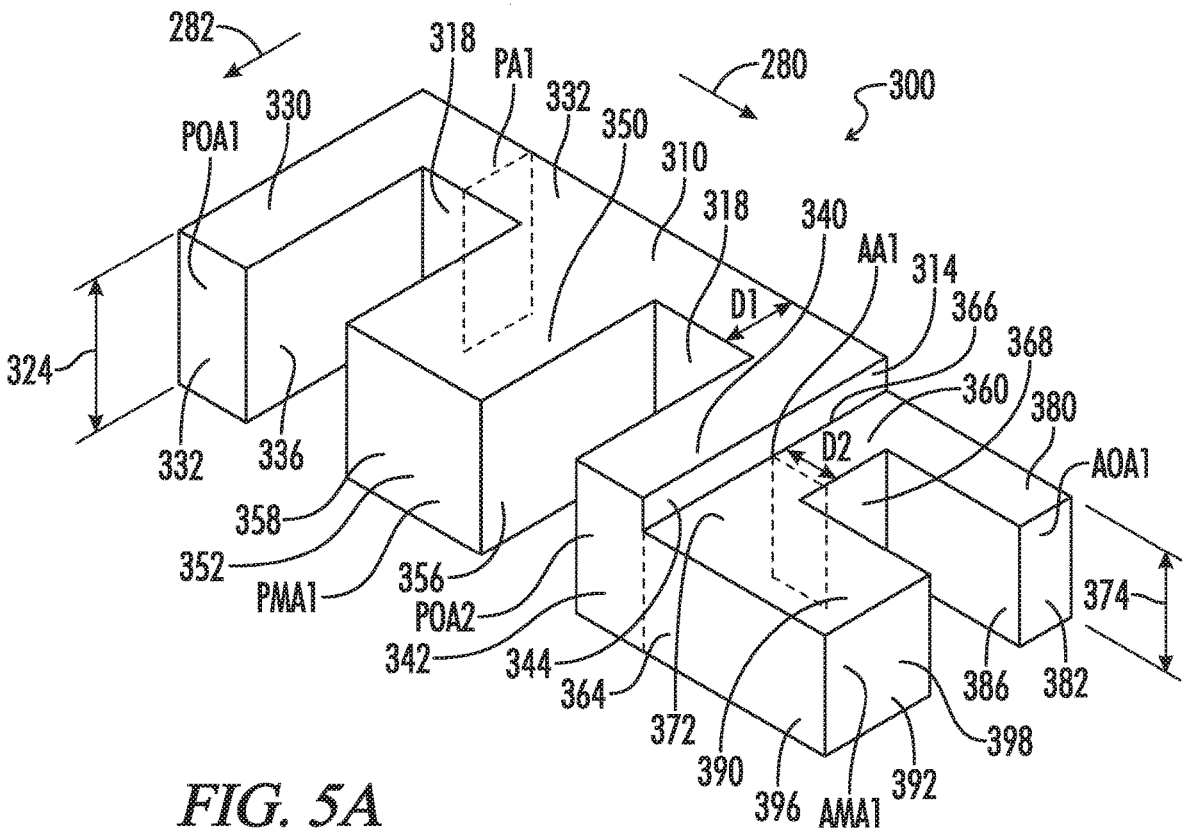
FIG. 5A illustrates an upper front perspective view of a first core piece of the core structure of the magnetic assembly of FIG. 3.
Figure 5B:
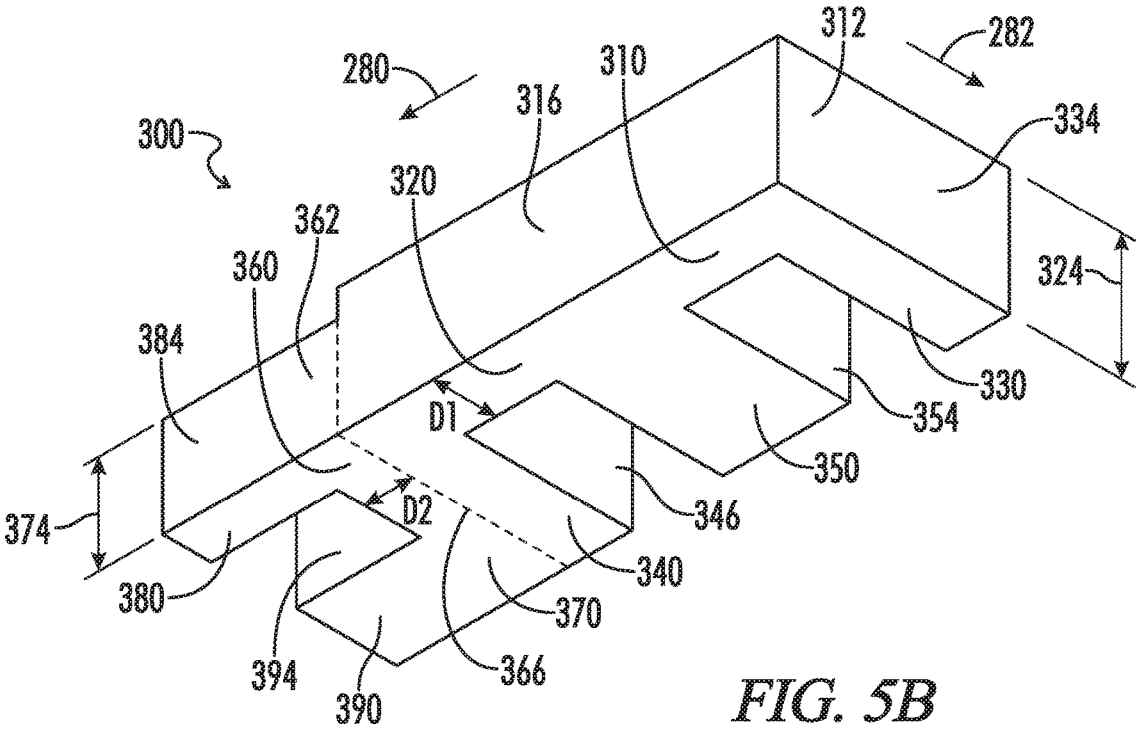
FIG. 5B illustrates a lower rear perspective view of the first core piece of FIG. 5A.

As shown in FIGS. 5A and 5B, for example, the first core piece 300 comprises a first primary core body 310 and a first auxiliary core body 360. The two bodies are integrally formed as a single core piece. The first primary core body 310 extends in a first direction 280 between a first end surface 312 (FIG. 5B) and a second end surface 314 (FIG. 5A). The first primary core body further includes an outer surface 316 (FIG. 5B), an inner surface 318 (FIG. 5A), a lower surface 320 (FIG. 5B), and an upper surface 322 (FIG. 5A). The inner surface 318 is spaced apart by a distance D1 from the outer surface 316. The first primary core body has a first primary core body height 324 defined between the lower surface and upper surface of the first primary core body.

A first primary outer leg 330 of the first core piece 300 extends in a second direction 282 from and is perpendicular to the inner surface 318 of the first primary core body 310 near the first end surface 312 of the first primary core body. The second direction 282 is perpendicular to the first direction 280. The first primary outer leg has a first primary outer leg end surface 332 (FIG. 5A). The first primary outer leg has an outer lateral surface 334 (FIG. 5B) and an inner lateral surface 336 (FIG. 5A). As shown in FIG. 5B, the outer lateral surface of the first primary outer leg is coplanar with the first end surface 312 of the first primary core body. The inner lateral surface of the first primary outer leg is parallel to the outer lateral surface of the first primary outer leg. In the illustrated embodiment, the first primary outer leg has a lower surface coplanar with the lower surface 320 of the first primary core body and has an upper surface coplanar with the upper surface 322 of the first primary core body. The common upper and lower surfaces of the first primary outer leg and the other legs described in the following paragraphs are not numbered separately.

A second primary outer leg 340 of the first core piece 300 extends in the second direction 282 from and is perpendicular to the inner surface 318 of the first primary core body 310 near the second end surface 314 of the first primary core body. The second primary outer leg has a second primary outer leg end surface 342 (FIG. 5A). The second primary outer leg has an outer lateral surface 344 (FIG. 5A) and an inner lateral surface 346 (FIG. 5B). As shown in FIG. 5A, the outer lateral surface of the second primary outer leg is coplanar with the second end surface 314 of the first primary core body. The inner lateral surface of the second primary outer leg is parallel to the outer lateral surface of the second primary outer leg. In the illustrated embodiment, the second primary outer leg has a lower surface coplanar with the lower surface 320 of the first primary core body and has an upper surface coplanar with the upper surface 322 of the first primary core body.

A first primary middle leg 350 of the first core portion 300 extends in the second direction 282 from and is perpendicular to the inner surface 318 of the first primary core body 310 approximately midway between the first end surface 312 and the second end surface 314 of the first primary core body. The first primary middle leg has a first primary middle leg end surface 352 (FIG. 5A). The first primary middle leg has a first lateral surface 354 (FIG. 5B) and a second lateral surface 356 (FIG. 5A). The first lateral surface faces toward the first end surface of the first primary core body. The second lateral surface faces toward the second end surface of the first primary core body. The first lateral surface and the second lateral surface are parallel to each other and parallel to the first and second end surfaces of the first primary core body. In the illustrated embodiment, the first primary middle leg has a lower surface coplanar with the lower surface 320 of the first primary core body and has an upper surface coplanar with the upper surface 322 of first primary core body. The first primary middle leg further has a first primary middle leg cross-sectional profile 358 (FIG. 5A), which corresponds to the shape of the first primary middle leg end surface 352.

The first auxiliary core body 360 extends in the second direction 282 between a first end surface 362 (FIG. 5B) and a second end surface 364 (FIG. 5A). The first auxiliary core body further includes an outer boundary 366 (FIG. 5A), an inner surface 368 (FIG. 5A), a lower surface 370 (FIG. 5B), and an upper surface 372 (FIG. 5A). The outer boundary is aligned with the second end surface 314 of the first primary core body 310 and with the outer lateral surface 344 of the second primary outer leg 340. The inner surface faces in the first direction 280. The inner surface 368 is spaced apart by a distance D2 (FIG. 5A) from the outer boundary 366. In the illustrated embodiment, the outer boundary 366 is integrally coupled to both the second end surface 314 of the first primary core body 310 and the outer lateral surface 344 of the second primary outer leg 340. As shown in FIG. 5B, the first end surface of the first auxiliary core body is coplanar with the outer lateral surface 316 of the first primary core body 310. As shown in FIG. 5A, the second end surface of the first auxiliary core body is coplanar with the second primary outer leg end surface 342. The first auxiliary core body has a first auxiliary core body height 374 defined between the lower surface and the upper surface of the first auxiliary core body. As illustrated, the first auxiliary core body height is less than the first primary core body height 324.

A first auxiliary outer leg 380 is integral with the first core piece 300. The first auxiliary outer leg extends in the first direction 280 from and is perpendicular to the inner surface 368 of the first auxiliary core body 360 near the first end surface 362 of the first auxiliary core body. The first auxiliary outer leg has a first auxiliary outer leg end surface 382 (FIG. 5A). The first auxiliary outer leg has an outer lateral surface 384 (FIG. 5B) and an inner lateral surface 386 (FIG. 5A). As shown in FIG. 5B, the outer lateral surface of the first auxiliary outer leg is coplanar with the first end surface 362 of the first auxiliary core body. The inner lateral surface of the first auxiliary outer leg is parallel to the outer lateral surface of the first auxiliary outer leg. In the illustrated embodiment, the first auxiliary outer leg has a lower surface coplanar with the lower surface 370 of the first auxiliary core body and has an upper surface coplanar with the upper surface 372 of the first auxiliary core body.

A first auxiliary middle leg 390 is integral with the first core piece 300. The first primary middle leg extends in the first direction 280 from and is perpendicular to the inner surface 368 of the first auxiliary core body 360 near the second end surface 364 of the first auxiliary core body. The first auxiliary middle leg has a first auxiliary middle leg end surface 392 (FIG. 5A). The first auxiliary middle leg has a first lateral surface 394 (FIG. 5B) and a second lateral surface 396 (FIG. 5A). The first lateral surface faces toward the first end surface 362 of the first auxiliary core body. As shown in FIG. 5A, the second lateral surface is coplanar with the second end surface 364 of the first auxiliary core body. The first lateral surface and the second lateral surface of the first auxiliary middle leg are parallel to each other and parallel to the first and second end surfaces of the first auxiliary core body. In the illustrated embodiment, the first auxiliary middle leg has a lower surface coplanar with the lower surface 370 of the first auxiliary core body and has an upper surface coplanar with the upper surface 372 of the first auxiliary core body. The first auxiliary middle leg further has a first auxiliary middle leg cross-sectional profile 398 (FIG. 5A), which corresponds to the shape of the first auxiliary middle leg end surface 392.

Figure 6A:
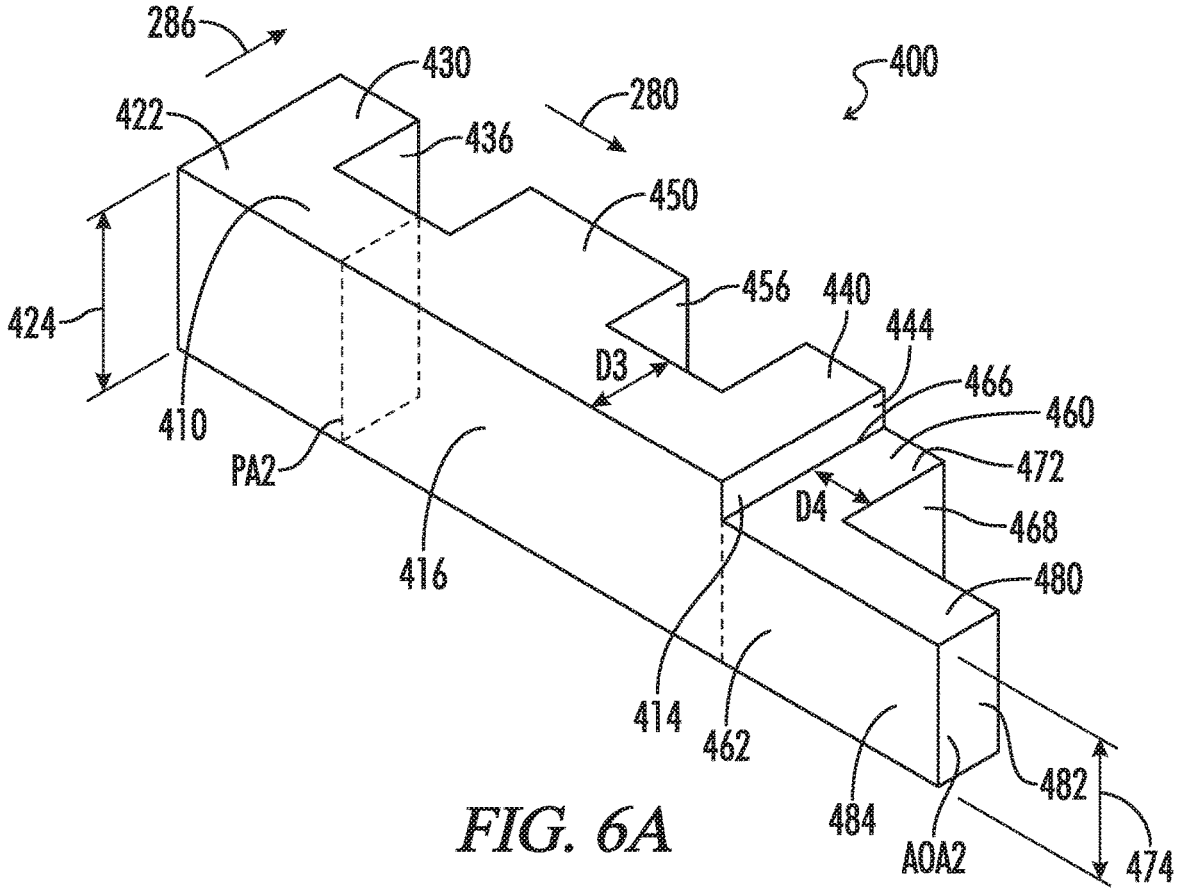
FIG. 6A illustrates an upper front perspective view of a second core piece of the core structure of the magnetic assembly of FIG. 3.
Figure 6B:
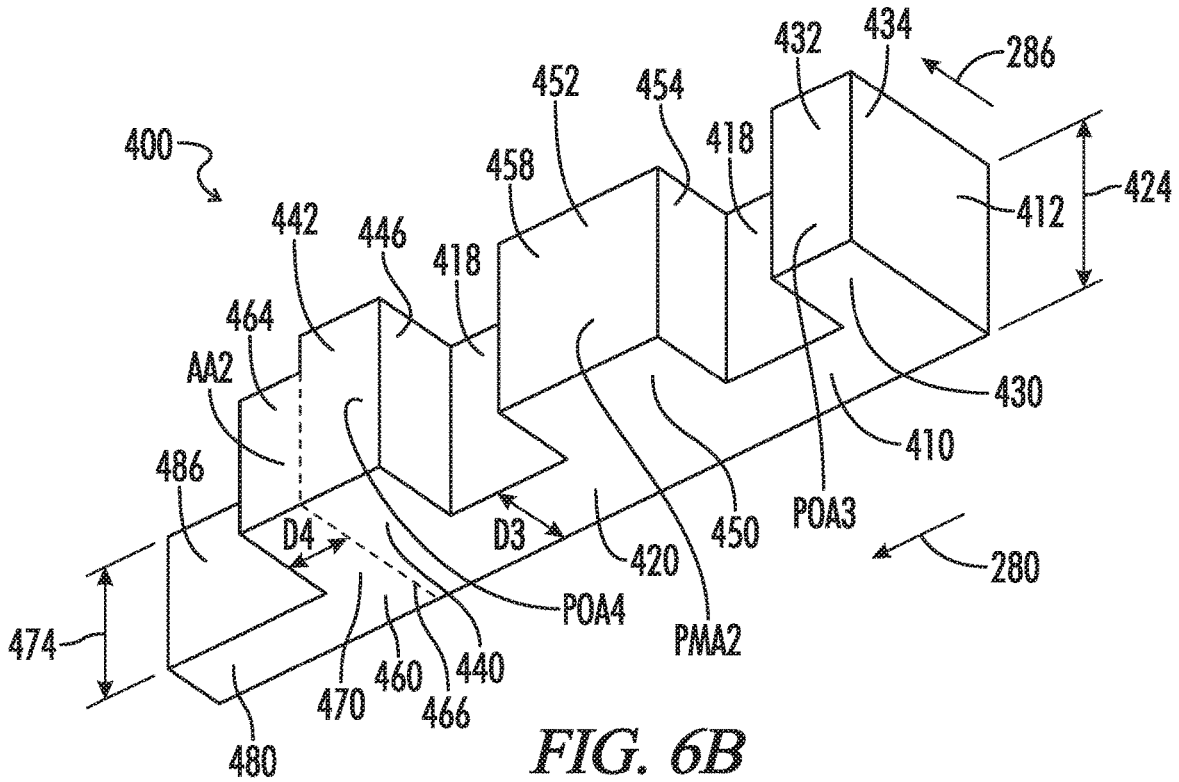
FIG. 6B illustrates a lower rear perspective view of the second core piece of FIG. 6A.
Figure 8:
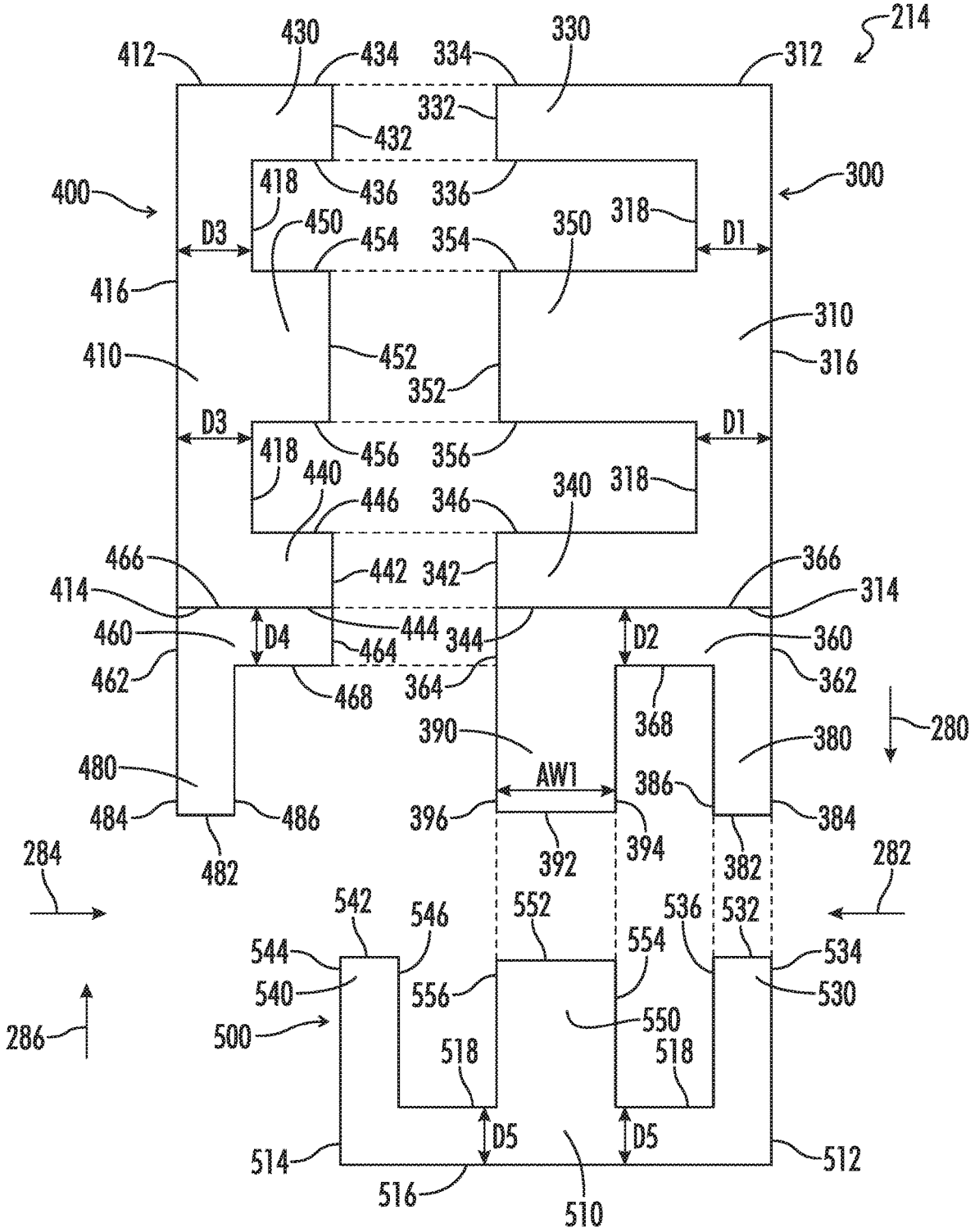
FIG. 8 illustrates a top plan view of the core structure of FIG. 3.

As shown in FIGS. 6A and 6B, the second core piece 400 comprises a second primary core body 410 and a second auxiliary core body 460. The two bodies are integrally formed as a single core piece. The second primary core body 410 extends in the first direction 280 between a first end surface 412 (FIG. 6B) and a second end surface 414 (FIG. 6A). The second primary core body further includes an outer surface 416 (FIG. 6A), an inner surface 418 (FIG. 6B), a lower surface 420 (FIG. 6B), and an upper surface 422 (FIG. 6A). The inner surface 418 is spaced apart by a distance D3 from the outer surface 416. As shown in FIG. 8, the distance D3 of the second primary core body is substantially equal to the distance D1 of the first primary core body 310. The second primary core body has a second primary core body height 424 defined between the lower surface and upper surface of the second primary core body. The second primary core body height 424 is substantially equal to the first primary core body height 324.

A third primary outer leg 430 of the second core piece 400 extends in a third direction 284 from and is perpendicular to the inner surface 418 of the second primary core body 410 near the first end surface 412 of the second primary core body. The third direction 284 is parallel to and opposite to the second direction 282. The third primary outer leg has a third primary outer leg end surface 432 (FIG. 6B). The third primary outer leg end surface is configured to abut the first primary outer leg end surface 332. The third primary outer leg has an outer lateral surface 434 (FIG. 6B) and an inner lateral surface 436 (FIG. 6A). As shown in FIG. 6B, the outer lateral surface of the third primary outer leg is coplanar with the first end surface 412 of the second primary core body. The inner lateral surface of the third primary outer leg is parallel to the outer lateral surface of the third primary outer leg. In the illustrated embodiment, the third primary outer leg has a lower surface coplanar with the lower surface 420 of the second primary core body and has an upper surface coplanar with the upper surface 422 of the second primary core body.

A fourth primary outer leg 440 of the second core piece 400 extends in the third direction 284 from and is perpendicular to the inner surface 418 of the second primary core body 410 near the second end surface 414 of the second primary core body. The fourth primary outer leg has a fourth primary outer leg end surface 442 (FIG. 6B). The fourth primary outer leg end surface is configured to abut the second primary outer leg end surface 342. The fourth primary outer leg has an outer lateral surface 444 (FIG. 6A) and an inner lateral surface 446 (FIG. 6B). As shown in FIG. 6A, the outer lateral surface of the fourth primary outer leg is coplanar with the second end surface 414 of the second primary core body. The inner lateral surface of the fourth primary outer leg is parallel to the outer lateral surface of the fourth primary outer leg. In the illustrated embodiment, the fourth primary outer leg has a lower surface coplanar with the lower surface 420 of the second primary core body and has an upper surface coplanar with the upper surface 422 of the second primary core body.

A second primary middle leg 450 of the second core portion 400 extends in the third direction 284 from and is perpendicular to the inner surface 418 of the second primary core body 410 approximately midway between the first end surface 412 and the second end surface 414 of the second primary core body. The second primary middle leg has a second primary middle leg end surface 452 (FIG. 6B). The second primary middle leg has a first lateral surface 454 (FIG. 6B) and a second lateral surface 456 (FIG. 6A). As shown in FIG. 6B, the first lateral surface faces toward the first end surface of the second primary core body. As shown in FIG. 6A, the second lateral surface faces toward the second end surface of the second primary core body. The first lateral surface and the second lateral surface are parallel to each other and are parallel to the first and second end surfaces of the second primary core body. In the illustrated embodiment, the second primary middle leg has a lower surface coplanar with the lower surface 420 of the second primary core body and has an upper surface coplanar with the upper surface 422 of second primary core body. The second primary middle leg further has a second primary middle leg cross-sectional profile 458 (FIG. 6B), which corresponds to the shape of the second primary middle leg end surface 452.

A first common height is shared by the first and second primary core bodies, 310, 410, the first, second, third, and fourth primary outer legs, 330, 340, 430, 440, and the first and second primary middle legs 350, 450. The first common height is substantially equal to each of the first and second primary core body heights 324, 424.

The second auxiliary core body 460 extends in the third direction 284 between a first end surface 462 (FIG. 6A) and a second end surface 464 (FIG. 6B). The second auxiliary core body further includes an outer boundary 466 (FIGS. 6A and 6B), an inner surface 468 (FIG. 6A), a lower surface 470 (FIG. 6B), and an upper surface 472 (FIG. 6A). The outer boundary 466 is aligned with the second end surface 414 of the second primary core body 410 and with the outer surface 444 of the fourth primary outer leg 440. As shown in FIGS. 6A and 6B, the outer boundary is shown as a solid line in some places and as a dashed line in others, both representative of the outer boundary. The inner surface faces the first direction 280. The inner surface 468 is spaced apart by a distance D4 from the outer boundary 466. In the illustrated embodiment, the outer boundary 466 is integrally coupled to both the second end surface 414 of the second primary core body 410 and the outer surface 444 of the fourth primary outer leg 440. The first end surface of the second auxiliary core body is coplanar with the outer surface 416 of the second primary core body 410. The second end surface of the second auxiliary core body is coplanar with the fourth primary outer leg end surface 442. The second auxiliary core body has a second auxiliary core body height 474 defined between the lower surface and upper surface of the second auxiliary core body. The second auxiliary core body height is substantially equal to the first auxiliary core body height 374. In the illustrated embodiment, the first and second auxiliary core body heights are less than the first and second primary core body heights 324, 424. In other embodiments, the first and second auxiliary core body heights may be equal to or greater than the first and second primary core body heights.

A second auxiliary outer leg 480 is integral to the second core piece 400. The second auxiliary outer leg extends in the first direction 280 from and is perpendicular to the inner surface 468 of the second auxiliary core body 460 near the first end surface 462 of the second auxiliary core body. The second auxiliary outer leg has a second auxiliary outer leg end surface 482 (FIG. 6A). The second auxiliary outer leg has an outer lateral surface 484 (FIG. 6A) and an inner lateral surface 486 (FIG. 6B). As shown in FIG. 6A, the outer lateral surface of the second auxiliary outer leg is coplanar with the first end surface 462 of the second auxiliary core body. The inner lateral surface of the second auxiliary outer leg is parallel to the outer lateral surface of the second auxiliary outer leg. In the illustrated embodiment, the second auxiliary outer leg has a lower surface coplanar with the lower surface 470 of second first auxiliary core body and has an upper surface coplanar with the upper surface 472 of the second auxiliary core body.

Figure 7A:
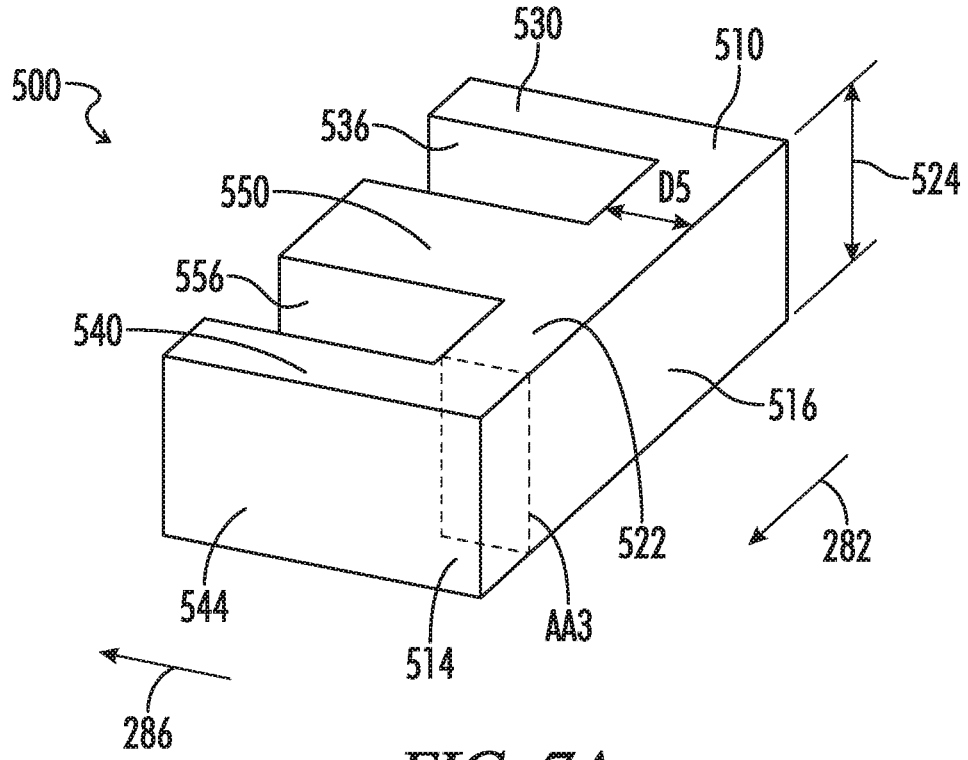
FIG. 7A illustrates an upper front perspective view of a third core piece of the core structure of the magnetic assembly of FIG. 3.
Figure 7B:
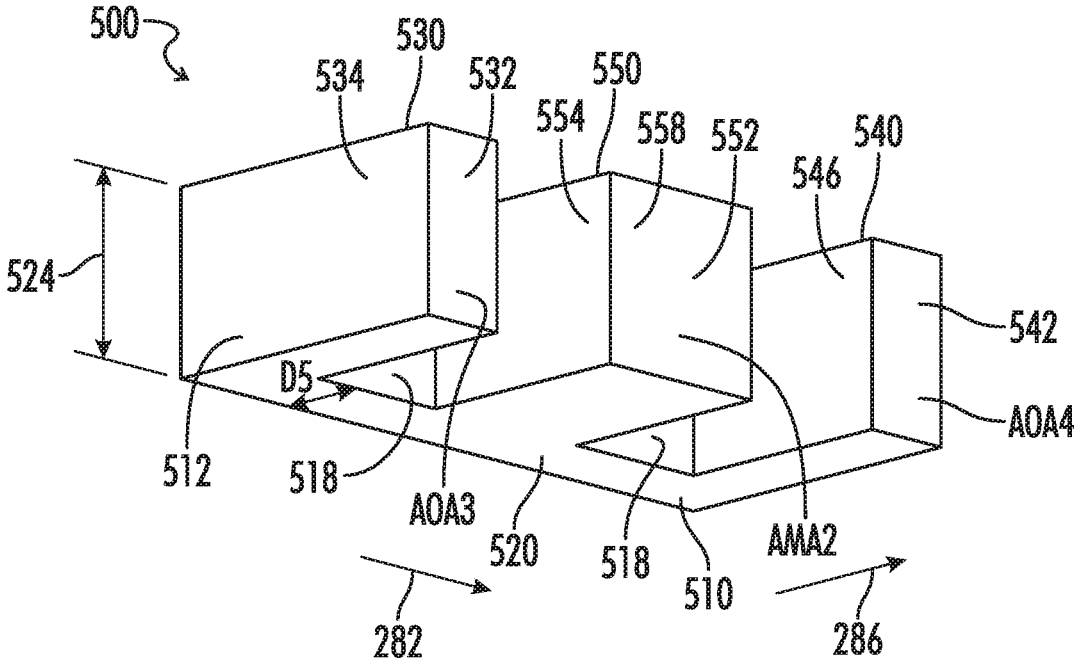
FIG. 7B illustrates a lower rear perspective view of the third core piece of the magnetic assembly of FIG. 7A.

As shown in FIGS. 7A and 7B, the third core piece 500 comprises a third auxiliary core body 510. The third auxiliary core body 510 extends in the second direction 282 between a first end surface 512 (FIG. 7B) and a second end surface 514 (FIG. 7A). The third auxiliary core body further includes an outer surface 516 (FIG. 7A), an inner surface 518 (FIG. 7B), a lower surface 520 (FIG. 7B), and an upper surface 522 (FIG. 7A). The inner surface faces a fourth direction 286. The fourth direction 286 is parallel to and opposite to the first direction 280. The inner surface 518 is spaced apart by a distance D5 from the outer surface 516. As shown in FIG. 8, each of the distances D2, D4, D5 of the first, second, and third auxiliary core bodies 360, 460, 510, respectively, are substantially equal. The third auxiliary core body has a third auxiliary core body height 524 defined between the lower surface and upper surface of the third auxiliary core body. The first, second, and third auxiliary core body heights 374, 474, 524 are substantially equal. In the illustrated embodiment, the first, second, and third auxiliary core body heights are less than the first and second primary core body heights 324, 424. In other embodiments, the first, second and third auxiliary core body heights may be equal to or greater than the first and second primary core body heights.

A third auxiliary outer leg 530 of the third core piece 500 extends in the fourth direction 286 from and is perpendicular to the inner surface 518 of the third auxiliary core body 510 near the first end surface 512 of the third auxiliary core body. The third auxiliary outer leg has a third auxiliary outer leg end surface 532 (FIG. 7B). The third auxiliary outer leg end surface is configured to abut the first auxiliary outer leg end surface 382. The third auxiliary outer leg has an outer lateral surface 534 (FIG. 7B) and an inner lateral surface 536 (FIG. 7A). As shown in FIG. 7B, the outer lateral surface of the third auxiliary outer leg is coplanar with the first end surface 512 of the third auxiliary core body. The inner lateral surface of the third auxiliary outer leg is parallel to the outer lateral surface of the third auxiliary outer leg. In the illustrated embodiment, the third auxiliary outer leg has a lower surface coplanar with the lower surface 520 of the third auxiliary core body and has an upper surface coplanar with the upper surface 522 of the third auxiliary core body.

A fourth auxiliary outer leg 540 of the third core piece 500 extends in the fourth direction 286 from and is perpendicular to the inner surface 518 of the third auxiliary core body 510 near the second end surface 514 of the third auxiliary core body. The fourth auxiliary outer leg has a fourth auxiliary outer leg end surface 542 (FIG. 7B). The fourth auxiliary outer leg end surface is configured to abut the second auxiliary outer leg end surface 482. The fourth auxiliary outer leg has an outer lateral surface 544 (FIG. 7A) and an inner lateral surface 546 (FIG. 7B). As shown in FIG. 7A, the outer lateral surface of the fourth auxiliary outer leg is coplanar with the first end surface 512 of the third auxiliary core body. The inner lateral surface of the fourth auxiliary outer leg is parallel to the outer lateral surface of the fourth auxiliary outer leg. In the illustrated embodiment, the fourth auxiliary outer leg has a lower surface coplanar with the lower surface 520 of the third auxiliary core body and has an upper surface coplanar with the upper surface 522 of the third auxiliary core body.

A second auxiliary middle leg 550 of the third core piece 500 extends in the fourth direction 286 from and is perpendicular to the inner surface 518 of the third auxiliary core body 510 near the second end surface 514 of the third auxiliary core body. The second auxiliary middle leg has a second auxiliary middle leg end surface 552 (FIG. 7B). The second auxiliary middle leg has a first lateral surface 554 (FIG. 7B) and a second lateral surface 556 (FIG. 7A). The first lateral surface faces toward the first end surface of the third auxiliary core body. The second lateral surface faces toward the second end surface of the third auxiliary core body. The first lateral surface and the second lateral surface are parallel to each other and parallel to the first and second end surfaces of the third auxiliary core body. In the illustrated embodiment, the second auxiliary middle leg has a lower surface coplanar with the lower surface 520 of the third auxiliary core body and has an upper surface coplanar with the upper surface 522 of third auxiliary core body. The second auxiliary middle leg further has a second auxiliary middle leg cross-sectional profile 558 (FIG. 7B), which corresponds to the shape of the second auxiliary middle leg end surface 552.

A second common height is shared by the first, second, and third auxiliary core bodies, 360, 460, 510, the first, second, third, and fourth auxiliary outer legs, 380, 480, 530, 540, and the first and second auxiliary middle legs 390, 550. In the illustrated embodiment, the second common height is less than the first common height, defined above. In other embodiments, the second common height may be equal to or greater than the first common height.

Figure 9:
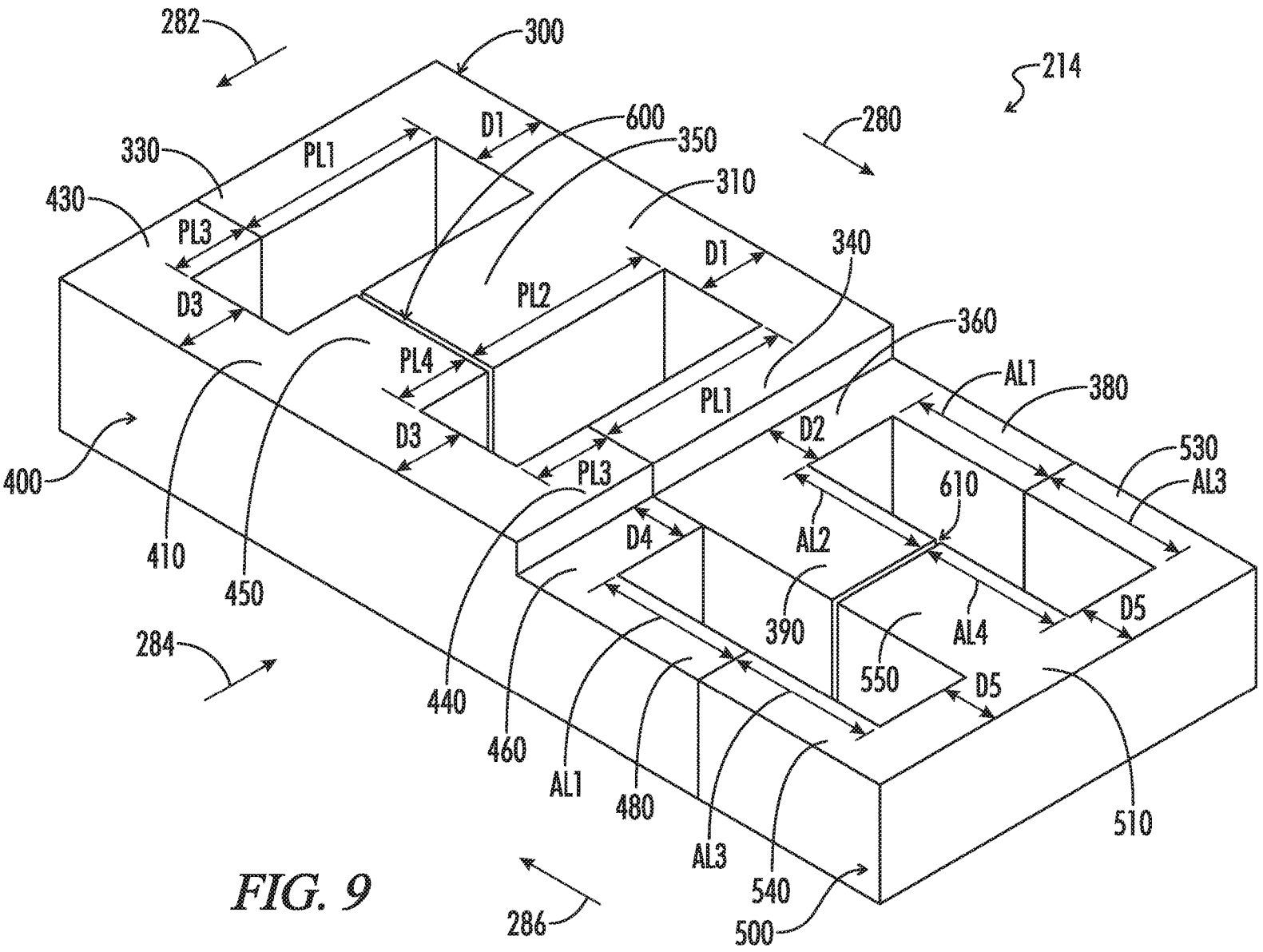
FIG. 9 illustrates an upper front perspective view of the core structure juxtaposed to show the winding windows formed between the legs of the core structure of the magnetic component of FIG. 3.
Figure 10:
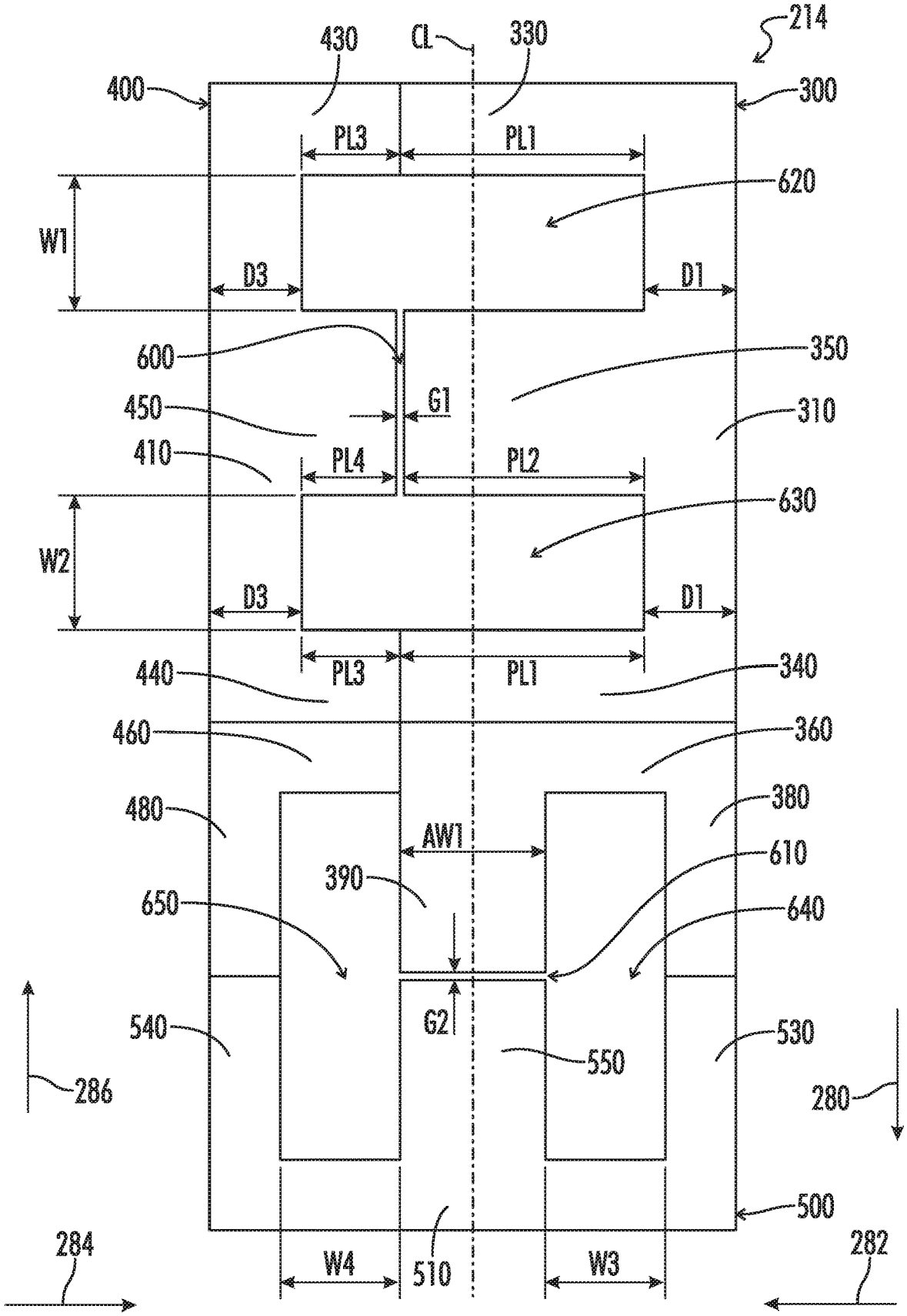
FIG. 10 illustrates a top plan view of the core structure of FIG. 9.
Figure 11:
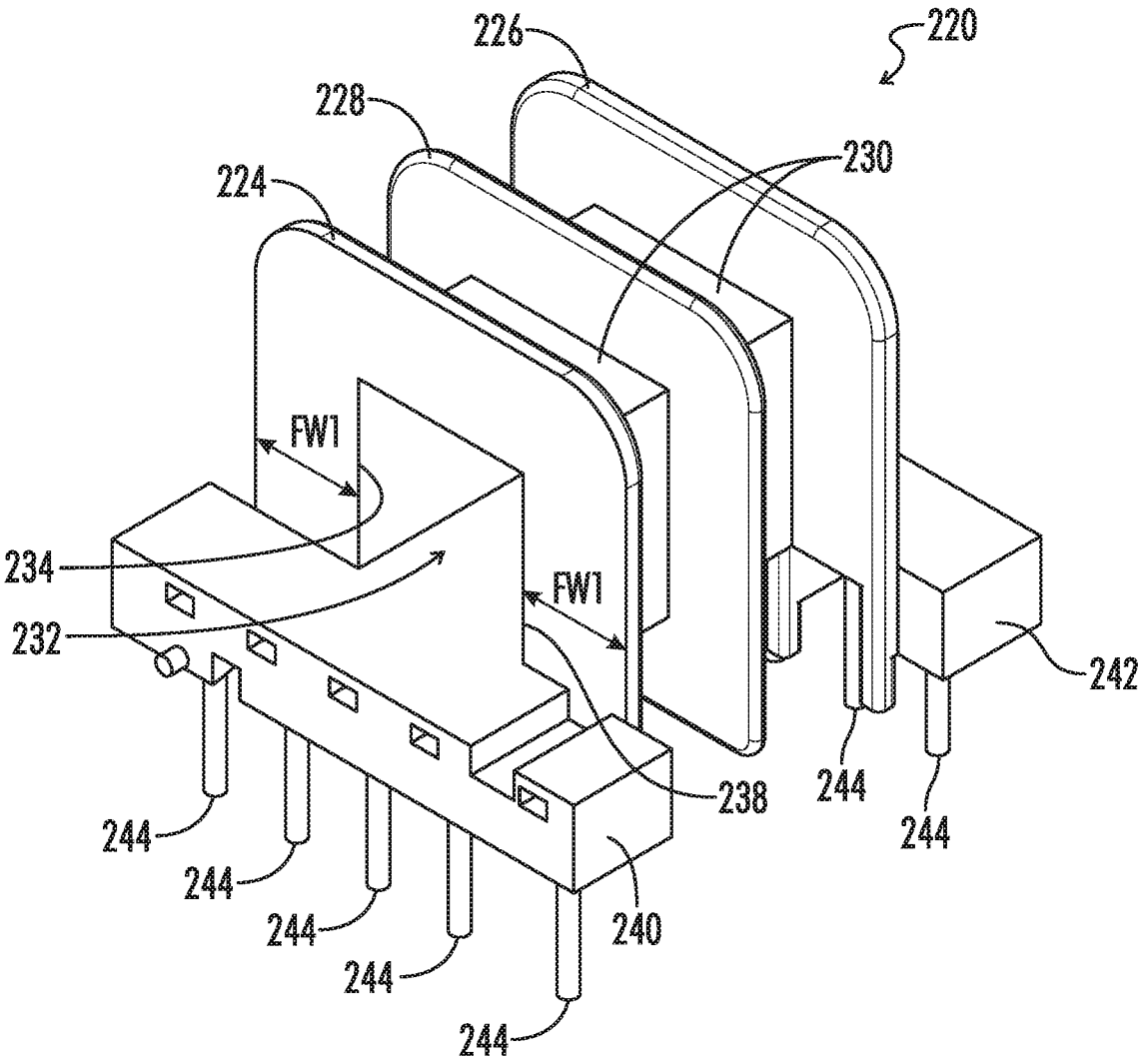
FIG. 11 illustrates an upper front perspective view of the first bobbin of the leftmost magnetic component of FIG. 3.

When the three core pieces 300, 400, 500 of the core structure 214 are mated (e.g., abutted) as shown in FIGS. 9 and 10, the first primary outer leg end surface 332 of the first core piece 300 and the third primary outer leg 432 of the second core piece 400 are positioned adjacent to each other. The second primary outer leg end surface 342 of the first core piece 300 and the fourth primary outer leg 442 of the second core piece 400 are positioned adjacent to each other. The first auxiliary outer leg end surface 382 of the first core piece 300 and the third auxiliary outer leg 532 of the third core piece 500 are positioned adjacent to each other. The second auxiliary outer leg end surface 482 of the second core piece 400 and the fourth auxiliary outer leg 542 of the third core piece 500 are positioned adjacent to each other. The first primary middle leg end surface 352 of the first core piece 300 and the second primary middle leg end surface 452 of the second core piece 400 are positioned adjacent to each other. The first auxiliary middle leg end surface 392 of the first core piece 300 and the second auxiliary middle leg end surface 552 of the third core piece 500 are positioned adjacent to each other. As described below, the respective end surfaces of the adjacent outer legs are abutting. In the illustrated embodiment, the respective end surfaces of the adjacent middle legs are shown spaced apart to form a gap therebetween. In other embodiments (not shown), the respective end surfaces of the adjacent middle legs may be abutting.

The first and second primary outer legs 330, 340 of the first core piece 300 have a common first primary length PL1 that is defined between the inner surface 318 of the first primary core body 310 and the first and second primary outer leg end surfaces 332, 342, respectively. The first primary middle leg 350 of the first core piece has a second primary length PL2 that is defined between the inner surface of the first primary core body and the first primary middle leg end surface 352. The third and fourth primary outer legs 430, 440 of the second core piece 400 have a common third primary length PL3 that is defined between the inner surface 418 of the second primary core body 410 and the third and fourth primary outer leg end surfaces 432, 442, respectively. The second primary middle leg 450 of the second core piece has a fourth primary length PL4 that is defined between the inner surface of the second primary core body and the second primary middle leg end surface 452.

In the illustrated embodiment, the second primary length PL2 is shorter than the common first primary length PL1 to form a first portion of a primary gap described below. The fourth primary length PL4 is shorter than the common third primary length PL3 to form a second portion of the primary gap.

In order to align the second lateral surface 396 of the first auxiliary middle leg 390 with second primary outer leg end surface 342, the common first length PL1 is longer than the common third primary length by at least a width AW1 (FIGS. 8 and 10) of the first auxiliary middle leg 390 of the first core piece 300. This ensures that the first auxiliary middle leg is not split along its length. The foregoing can be shown by assuming the centerline of the first auxiliary middle leg is aligned with the overall center line CL of the core structure 214 when the end surfaces of the outer legs of the primary core pieces are mated as shown in FIG. 10. The centerline is thus located at a distance of ½(PL1+PL3+D1+D3). In the illustrated embodiment, D1 and D3 are equal. Thus, the centerline is located at ½(PL1+PL3)+D1. The location of the centerline can also be expressed as (PL1+D3)−½AW1. The two expressions can be equated such that ½(PL1+PL3)+D1=(PL1+D3)−½AW1. The equation reduces to (PL1−PL3)=AW1. In other embodiments, the lengths may be varied, which may result in the first auxiliary leg not being centered with respect to the overall core structure.

A first gap 600 may be defined between the first primary middle leg end surface 352 of the first core piece 300 and the second primary middle leg end surface 452 of the second core piece 400. The first gap 600 includes a first gap width G1. The first gap width G1 is calculated as G1=(PL1−PL2)+(PL3−PL4). The first gap may also be formed by making only one of the primary middle legs shorter than the adjacent primary outer legs by a single difference corresponding to the gap width G1 (e.g., G1=(PL1−PL2) or G1=(PL3−PL4).

The first auxiliary outer leg 380 of the first core piece 300 and the second auxiliary outer leg 480 of the second core piece 400 have a common first auxiliary length AL1 that is defined between the inner surface 368 of the first auxiliary core body 360 and the first auxiliary outer leg end surface 382. The common first auxiliary length AL1 is also defined between the inner surface 468 of the second auxiliary core body 460 and the second auxiliary outer leg end surface 482. The first auxiliary middle leg 390 of the first core piece has a second auxiliary length AL2 that is defined between the inner surface of the first auxiliary core body and the first auxiliary middle leg end surface 392. The third and fourth auxiliary outer legs 530, 540 of the third core piece 500 have a common third auxiliary length AL3 that is defined between the inner surface 518 of the third auxiliary core body 510 and the third and fourth auxiliary outer leg end surfaces 532, 542, respectively. The second auxiliary middle leg 550 of the third core piece has a fourth auxiliary length AL4 that is defined between the inner surface of the third auxiliary core body and the second auxiliary middle leg end surface 552.

In the illustrated embodiment, the second auxiliary length AL2 of the first auxiliary middle leg 390 is shorter than the common first auxiliary length AL1 of the inner lateral surfaces of the first and second auxiliary outer legs 380, 480. The fourth auxiliary length AL4 of the second auxiliary middle leg 550 is shorter than the common third auxiliary length AL3 of the third and fourth auxiliary middle legs 530, 540. When the three core pieces 300, 400, 500 are abutted as shown in FIGS. 9 and 10, for example, a second gap 610 may be defined between the first auxiliary middle leg end surface 392 of the first core piece 300 and the second auxiliary middle leg end surface 552 of the third core piece 500. The second gap 610 includes a second gap width G2. The second gap width G2 is calculated as G2=(AL1−AL2)+(AL3−AL4). In alternative embodiments, the second gap may be formed by making only one of the auxiliary middle legs shorter than the adjacent auxiliary outer legs by a single difference corresponding to the gap width G2 (e.g., G2=(AL1−AL2) or G2=(AL3−AL4).

The first primary core body includes a first primary core body cross-sectional area PA1 (FIG. 5A). The second primary core body includes a second primary core body cross-sectional area PA2 (FIG. 6A). The first primary outer leg includes a first primary outer leg cross-sectional area POA1 (FIG. 5A). The second primary outer leg includes a second primary outer leg cross-sectional area POA2 (FIG.

5A). The third primary outer leg includes a third primary outer leg cross-sectional area POA3 (FIG. 6B). The fourth primary outer leg includes a fourth primary outer leg cross-sectional area POA4 (FIG. 6B). The first primary middle leg includes a first primary middle leg cross-sectional area PMA1 (FIG. 5A). The second primary middle leg includes a second primary middle leg cross-sectional area PMA2 (FIG. 6B). The first auxiliary core body includes a first auxiliary core body cross-sectional area AA1 (FIG. 5A). The second auxiliary core body includes a second auxiliary core body cross-sectional area AA2 (FIG. 6B). The third auxiliary core body includes a third auxiliary core body cross-sectional area AA3 (FIG. 7A). The first auxiliary outer leg includes a first auxiliary outer leg cross-sectional area AOA1 (FIG. 5A). The second auxiliary outer leg includes a second auxiliary outer leg cross-sectional area AOA2 (FIG. 6A). The third auxiliary outer leg includes a third auxiliary outer leg cross-sectional area AOA3 (FIG. 7B). The fourth auxiliary outer leg includes a fourth auxiliary outer leg cross-sectional area AOA4 (FIG. 7B). The first auxiliary middle leg includes a first auxiliary middle leg cross-sectional area AMA1 (FIG. 5A). The second auxiliary middle leg includes a second auxiliary middle leg cross-sectional area AMA2 (FIG. 7B).

The first primary core body cross-sectional area PA1 is at least as large as each of the first and second primary outer leg cross-sectional areas POA1, POA2, independently. The second primary core body cross-sectional area PA2 is at least as large each of the third and fourth primary outer leg cross-sectional areas POA3, POA4, independently. The first auxiliary core body cross-sectional area AA1 is at least as large the first auxiliary outer leg cross-sectional area AOA1. The second auxiliary core body cross-sectional area AA2 is at least as large the second auxiliary outer leg cross-sectional area AOA2. The third auxiliary core body cross-sectional area AA3 is at least as large each of the third and fourth auxiliary outer leg cross-sectional areas AOA3, AOA4, independently.

The first primary core body cross-sectional area PA1, the first primary outer leg cross-sectional area POA1, and the second primary outer leg cross-sectional area POA2 are substantially equal. The second primary core body cross-sectional area PA2, the third primary outer leg cross-sectional area POA3, and the fourth primary outer leg cross-sectional area POA4 are substantially equal. The first auxiliary core body cross-sectional area AA1, the second auxiliary core body cross-sectional area AA2, the first auxiliary outer leg cross-sectional area AOA1, and the second auxiliary outer leg cross-sectional area AOA2 are substantially equal. The third auxiliary core body cross-sectional area AA3, the third auxiliary outer leg cross-sectional area AOA3, and the fourth auxiliary outer leg cross-sectional area AOA4 are substantially equal.

The first primary middle leg cross-sectional area PMA1 is at least as great as the sum of the first primary outer leg cross-sectional area POA1 and the second primary outer leg cross-sectional area POA2. The second primary middle leg cross-sectional area PMA2 is at least as great as the sum of the third primary outer leg cross-sectional area POA3 and the fourth primary outer leg cross-sectional area POA4. The first auxiliary middle leg cross-sectional area AMA1 is at least as great as the sum of the first auxiliary outer leg cross-sectional area AOA1 and the second auxiliary outer leg cross-sectional area AOA2. The second auxiliary middle leg cross-sectional area AMA2 is at least as great as the sum of the third auxiliary outer leg cross-sectional area AOA3 and the fourth auxiliary outer leg cross-sectional area AOA4.

As illustrated in FIG. 10, the juxtaposition of the end surfaces of the six legs forms four winding windows in the core structure 214. A first winding window 620 is formed between the juxtaposed first and third primary outer legs 330, 430 and the juxtaposed first and second primary middle legs 350, 450. The first winding window has a width W1 determined by either the leg spacing between the inner lateral surface 336 of the first primary outer leg and the first lateral surface 354 of the first primary middle leg or the leg spacing between the inner lateral surface 436 of the third primary outer leg and the first lateral surface 454 of the second primary middle leg. The first winding window has a respective length determined by the sum of the common first primary length PL1 of the first primary outer leg and the common third primary length PL3 of the third primary outer leg.

A second winding window 630 is formed between the juxtaposed first and second primary middle legs 350, 450 and the juxtaposed second and fourth primary outer legs 340, 440. The second winding window has a width W1 determined by either the leg spacing between the second lateral surface 356 of the first primary middle leg and the inner lateral surface 346 of the second primary outer leg, or the leg spacing between the second lateral surface 456 of the second primary middle leg and the inner lateral surface 446 of the fourth primary outer leg and. The second winding window has a respective length determined by the sum of the common first primary length PL1 of the second primary outer leg and the common third primary length PL3 of the fourth primary outer leg.

A third winding window 640 is formed between the juxtaposed first and third auxiliary outer legs 380, 530 and the juxtaposed first and second auxiliary middle legs 390, 550. The third winding window has a width W3 determined by either the leg spacing between the inner lateral surface 386 of the first auxiliary outer leg and the first lateral surface 394 of the first auxiliary middle leg, or the leg spacing between the inner lateral surface 536 of the third auxiliary outer leg and the first lateral surface 554 of the second auxiliary middle leg. The third winding window has a respective length determined by the sum of the common first auxiliary length AL1 of the first auxiliary outer leg and the common third auxiliary length AL3 of the third auxiliary outer leg.

A fourth winding window 650 is formed between the juxtaposed first and second auxiliary middle legs 390, 550 and the juxtaposed second and fourth auxiliary outer legs 480, 540. The fourth winding window has a width W4 determined by either the leg spacing between the second lateral surface 396 of the first auxiliary middle leg and the inner lateral surface 486 of the second auxiliary outer leg, or the leg spacing between the second lateral surface 556 of the second auxiliary middle leg and the inner lateral surface 546 of the fourth auxiliary outer leg. The fourth winding window has a respective length determined by the sum of the common first auxiliary length AL1 of the second auxiliary outer leg and the common third auxiliary length AL3 of the fourth auxiliary outer leg.

Figure 3:
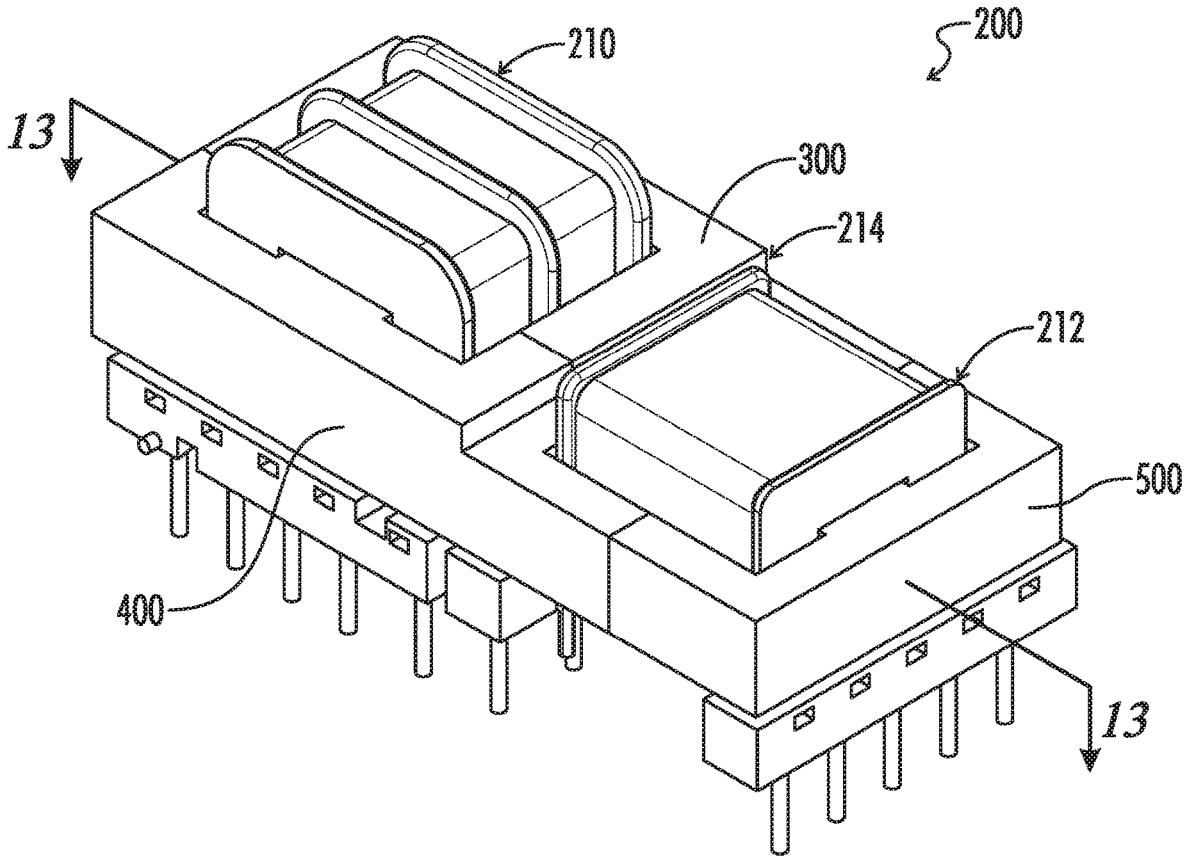
FIG. 3 illustrates an upper front perspective view of the single magnetic assembly of FIG. 2 prior to installation on the printed circuit.
Figure 4:
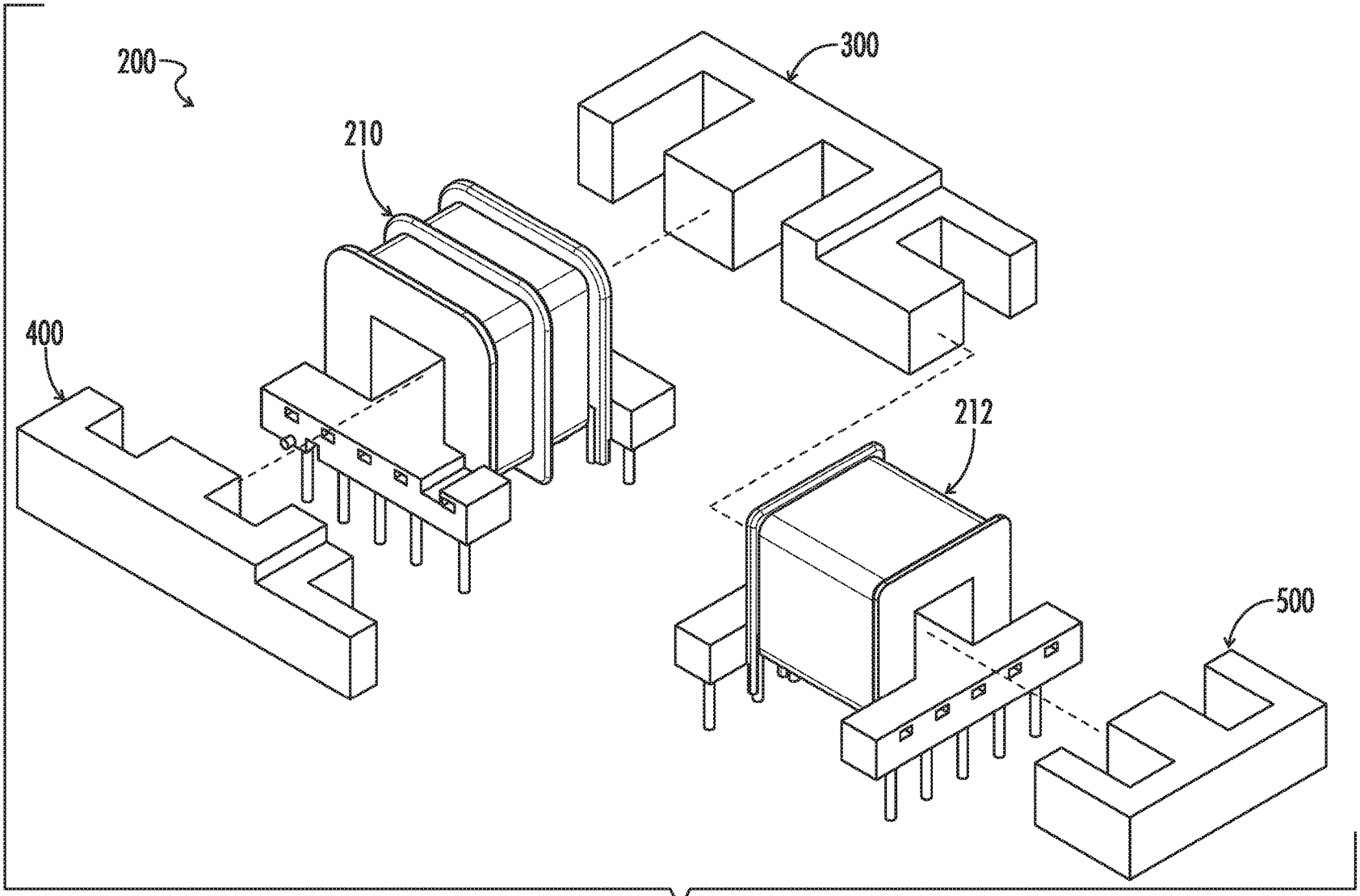
FIG. 4 illustrates an exploded upper front perspective view of the single magnetic assembly of FIG. 3.

As shown in FIG. 3, the first (leftmost) magnetic component 210 comprises a first bobbin 220 having a first winding 222. The first bobbin 220 may be referred to as a primary bobbin 220. The first bobbin is shown in more detail in FIG. 11. The first bobbin includes a first end flange 224 and a second end flange 226. The bobbin may further include at least one intermediate flange 228 positioned between the first and second end flanges. A coil winding surface 230 extends between the first end flange and the second end flange. The coil winding surface may be subdivided by the at least one intermediate flange 228, if present. The coil winding surface surrounds a first bobbin passageway 232. The first bobbin passageway is configured to receive at least one core leg of the core structure 214. In the illustrated embodiment, the first bobbin passageway receives the first primary middle leg 350 and the second primary middle leg 450. The first bobbin passageway has a first end 234, a second end 236, and a first bobbin passageway profile 238. The first end of the first bobbin passageway is collinear with an outer surface of the first end flange of the first bobbin. The second end of the first bobbin passageway is collinear with an outer surface of the second end flange of the first bobbin. Each flange has a width FW1 defined between the passageway and a lateral outer periphery of the flange that is selected to be no more than either width W1 or width W2 of the first and second winding windows 620, 630, respectively.

A first pin (or terminal) rail 240 extends from the first end flange 224. A second pin (or terminal) rail 242 extends from the second end flange 226. Each pin rail supports a plurality of pins (or terminals) 244. Selected ones of the pins are electrically connected to the first winding 222 by conductors (not shown) in a conventional manner.

Figure 13:
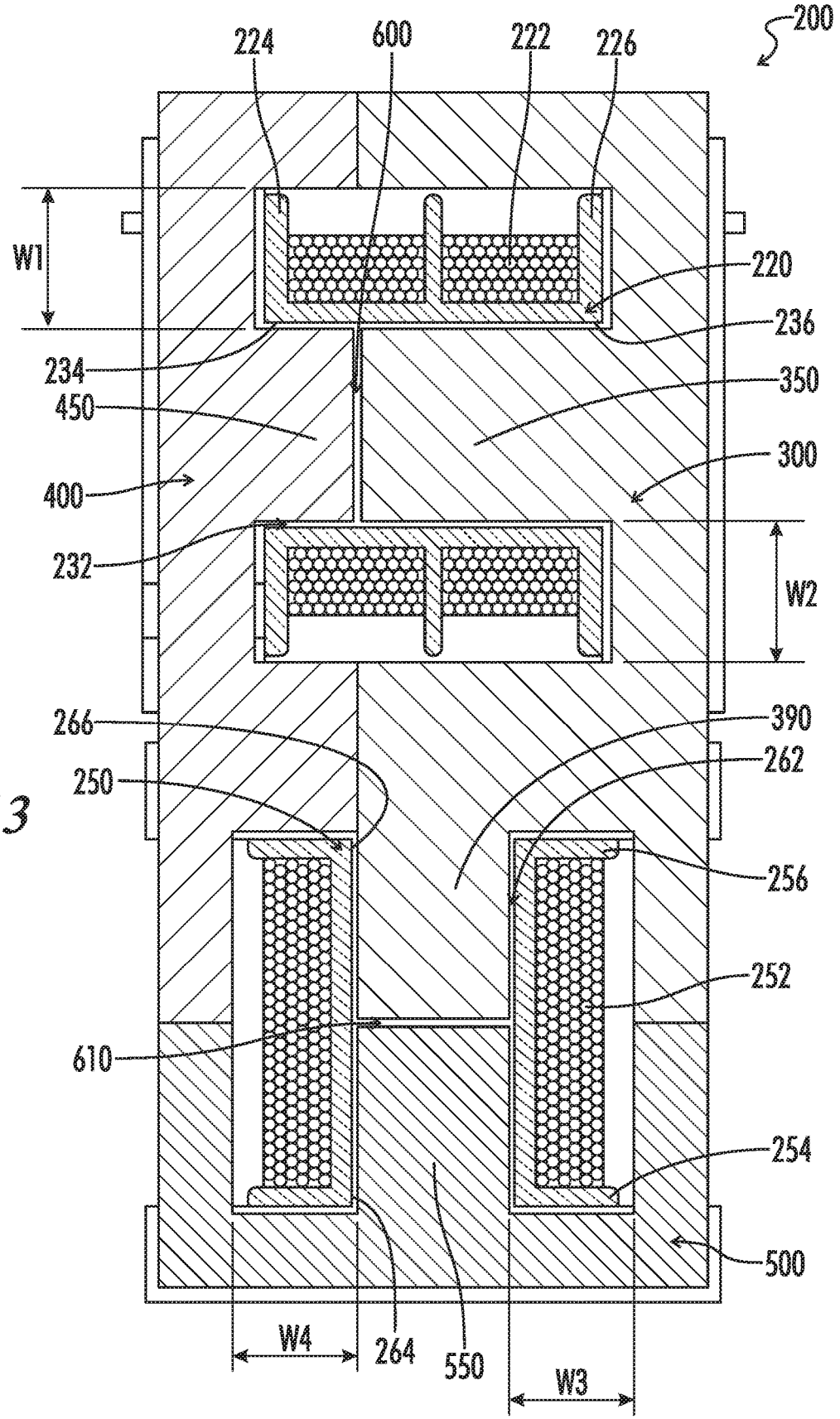
FIG. 13 illustrates a top plan cross-sectional view of the magnetic assembly of FIG. 3 taken along the line 13-13 of FIG. 3 showing the gaps between the ends of the outer legs of the core structure positioned within the passageways of the first and second bobbins of the leftmost and the rightmost magnetic components.

As shown, for example, in the cross-sectional view in FIG. 13, the first bobbin passageway profile 238 has a shape and a size configured to receive the first primary middle leg 350 from the second end 236 of the first bobbin passageway 232, and configured to receive the second primary middle leg 450 from the first end 234 of the first bobbin passageway. The first and second primary middle leg cross-sectional profiles 358, 458 of the first and second primary middle legs 350, 450, respectively, are configured to be substantially similar to the first bobbin passageway profile 238. The first gap 600 formed by the juxtaposed end surfaces 352, 452 of the first and second primary middle legs is positioned in the first bobbin passageway between the first end 234 and the second end 236. When positioned as shown in FIG. 3 (facing the first end flange 224 of the first bobbin), the respective leftmost portions of the flanges and the leftmost portion of the winding 222 fit within the first winding window 620 (FIG. 13). Likewise, when positioned as shown in FIG. 3, the respective rightmost portions of the flanges and the rightmost portion of the winding 222 fit within the second winding window 630 (FIG. 13).

Figure 12:
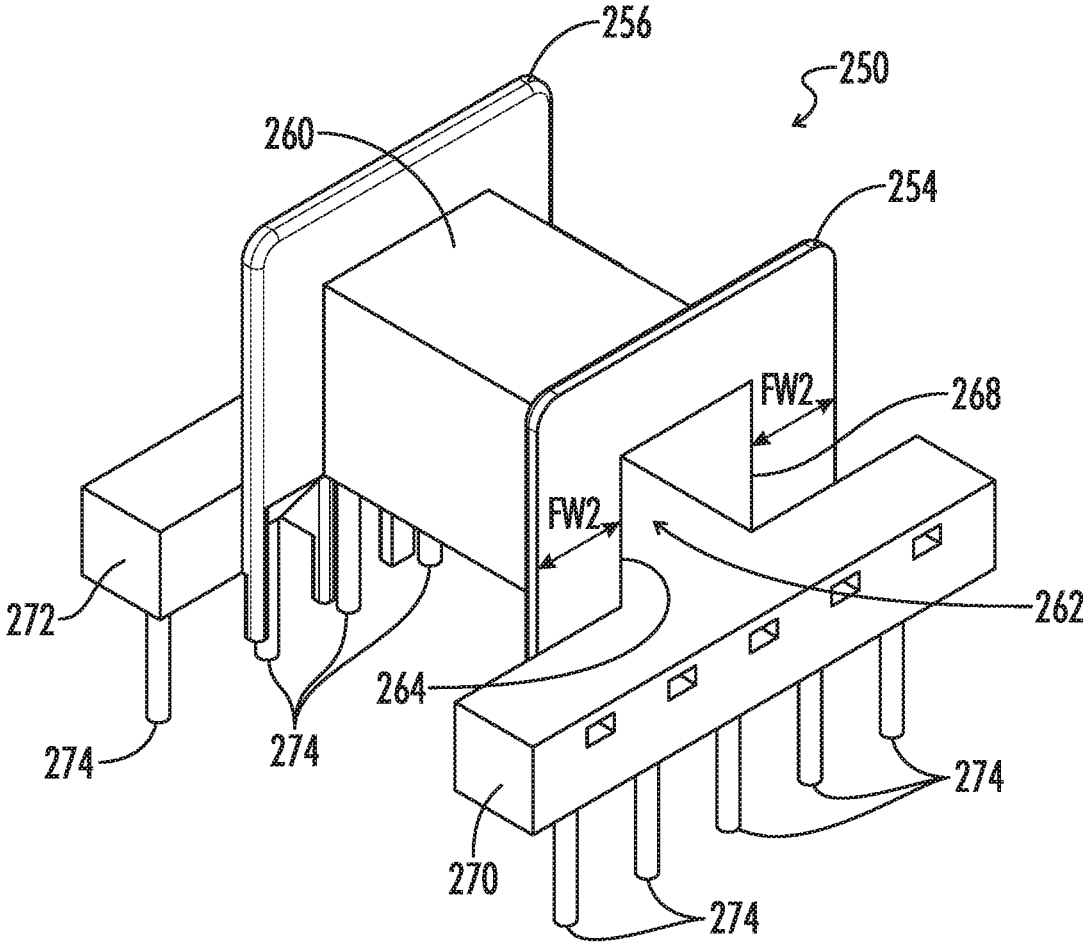
FIG. 12 illustrates an upper front perspective view of the second bobbin of the rightmost magnetic component of FIG. 3.

As shown in FIG. 12, the second (rightmost) magnetic component 212 (FIG. 3) comprises a second bobbin 250 having a second winding 252. In certain embodiments the second bobbin may have the same or substantially the same structure as the first bobbin 220; however, in the illustrated embodiment, the second bobbin differs from the first bobbin. The second bobbin 250 may be referred to as an auxiliary bobbin 250. The second bobbin includes a first end flange 254 and a second end flange 256. A coil winding surface 260 extends between the first end flange and the second end flange. In some embodiments, the coil winding surface may be subdivided by at least one intermediate flange (not shown). The coil winding surface surrounds a second bobbin passageway 262. The second bobbin passageway is configured to receive at least one core leg of the core structure 214. The second bobbin passageway has a first end 264, a second end 266, and a first bobbin passageway profile 268. The first end of the second bobbin passageway is collinear with an outer surface of the first end flange of the second bobbin. The second end of the second bobbin passageway is collinear with an outer surface of the second end flange of the second bobbin. Each flange has a width FW2 defined between the passageway and a lateral outer periphery of the flange that is selected to be no more than either width W3 or width W4 of the third and fourth winding windows 640, 650, respectively.

A first pin (or terminal) rail 270 extends from the first end flange 254. A second pin (or terminal) rail 272 extends from the second end flange 256. Each pin rail supports a plurality of pins (or terminals) 274. Selected ones of the pins are electrically connected to the first winding 252 by conductors (not shown) in a conventional manner.

As shown, for example, in the cross-sectional view in FIG. 13, the second bobbin passageway profile 268 has a shape and a size configured to receive the first auxiliary middle leg 390 from the second end 266 of the second bobbin passageway 262, and configured to receive the second auxiliary middle leg 550 from the first end 264 of the second bobbin passageway. The first and second auxiliary middle leg cross-sectional profiles 398, 558 are configured to be substantially similar to the second bobbin passageway profile 268. The second gap 610 formed by the juxtaposed end surfaces 392, 552 of the first and second auxiliary middle legs is positioned in the second bobbin passageway between the first end 264 and the second end 266. When positioned as shown in FIG. 3 (facing the first end flange 254 of the second bobbin), the respective leftmost portions of the flanges and the leftmost portion of the winding 252 fit within the third winding window 640 (FIG. 13). Likewise, when positioned as shown in FIG. 3, the respective rightmost portions of the flanges and the rightmost portion of the winding 252 fit within the fourth winding window 650 (FIG. 13).

Figure 14:
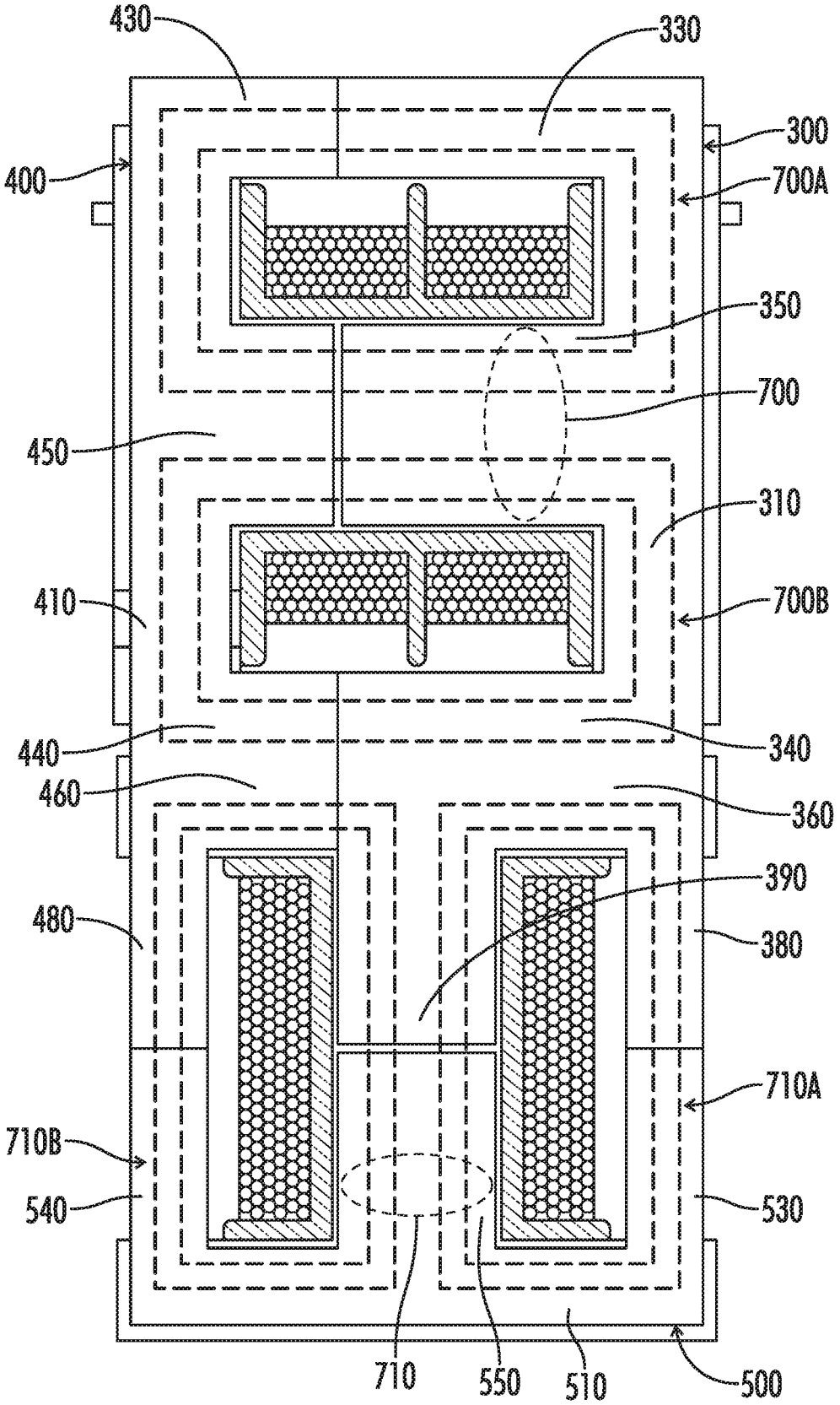
FIG. 14 pictorially illustrates the flux paths within the bodies and the legs of the core structure of the single magnetic assembly caused by the two independent magnetic components.

FIG. 14 pictorially represents the flux paths through the core structure 216 generated by the respective windings 222, 252 of the magnetic components 210, 212. As shown, the flux generated by the first winding 222 follows a first flux path 700, which passes through the first primary middle leg 350 and the second primary middle leg 450 positioned within the first bobbin passageway 232 onto which the first winding is wound, including the first gap 600. The first flux path splits into a first portion 700A and a second portion 700B. The first portion 700A of the first flux path passes through a portion of the second primary core body 410 of the second core piece 400 to the third primary outer leg 430. The second portion 700B of the first flux path passes through another portion of the second primary core body of the second core piece to the fourth primary outer leg 440. The first portion of the first flux path passes from the third primary outer leg through the first primary outer leg 330 of the first core piece 300. The second portion of the first flux path passes from the fourth primary outer leg through the second primary outer leg 340 of the first core piece. The first and second portions of the first flux path pass through respective portions of the first primary core body 310 of the first core piece and are recombined to pass back to the first and second primary middle legs positioned within the first winding. Accordingly, the first portion of the first flux path encompasses the first winding window 620, and the second portion of the first flux path encompasses the second winding window 630.

The flux generated by the second winding 252 follows a second flux path 710, which passes through the first auxiliary middle leg 390 and the second auxiliary middle leg 550 positioned within the second bobbin passageway 262 onto which the second winding is wound, including the second gap 610. The second flux path splits into a first portion 710A and a second portion 710B. The first portion 710A of the first flux path passes through a portion of the third auxiliary core body 510 of the third core piece 500 to the third auxiliary outer leg 530. The second portion 7108 of the first flux path passes through another portion of the third auxiliary core body of the third core piece to the fourth auxiliary outer leg 540. The first portion of the second flux path passes from the third auxiliary outer leg through the first auxiliary outer leg 380 of the first core piece 300. The second portion of the second flux path passes from the fourth auxiliary outer leg through the second auxiliary outer leg 480 of the second core piece 400. The first and second portions of the first flux path pass through respective portions of the first and second auxiliary core bodies 360, 460, of the first and second core pieces, respectively, and are recombined to pass back to the first and second auxiliary middle legs positioned within the second winding. Accordingly, the first portion of the second flux path encompasses the third winding window 640, and the second portion of the second flux path encompasses the fourth winding window 650.

As illustrated in FIG. 14, a portion of the flux generated by the first winding 222 passes along the second portion 700B of the first flux path 700 through the second and fourth primary outer legs 340, 440. The second portion 700B of the first flux path 700 is immediately adjacent the first portion 710A and the second portion 710B of the flux path 710 in the first and second auxiliary core body portions 360, 460 for the flux from the second winding 252. Although the flux paths for the flux generated by the two windings, are adjacent, the second primary outer leg cross-sectional area POA2, the fourth outer leg cross-sectional area POA4, the first auxiliary core body cross-sectional area AA1, and the second auxiliary core body cross-sectional area AA2 are selected to be sufficiently great in order to be able to accommodate the flux generated by the two windings without exceeding a desired flux density. Accordingly, the magnetic fluxes generated by two windings do not interact.

Figure 1B:
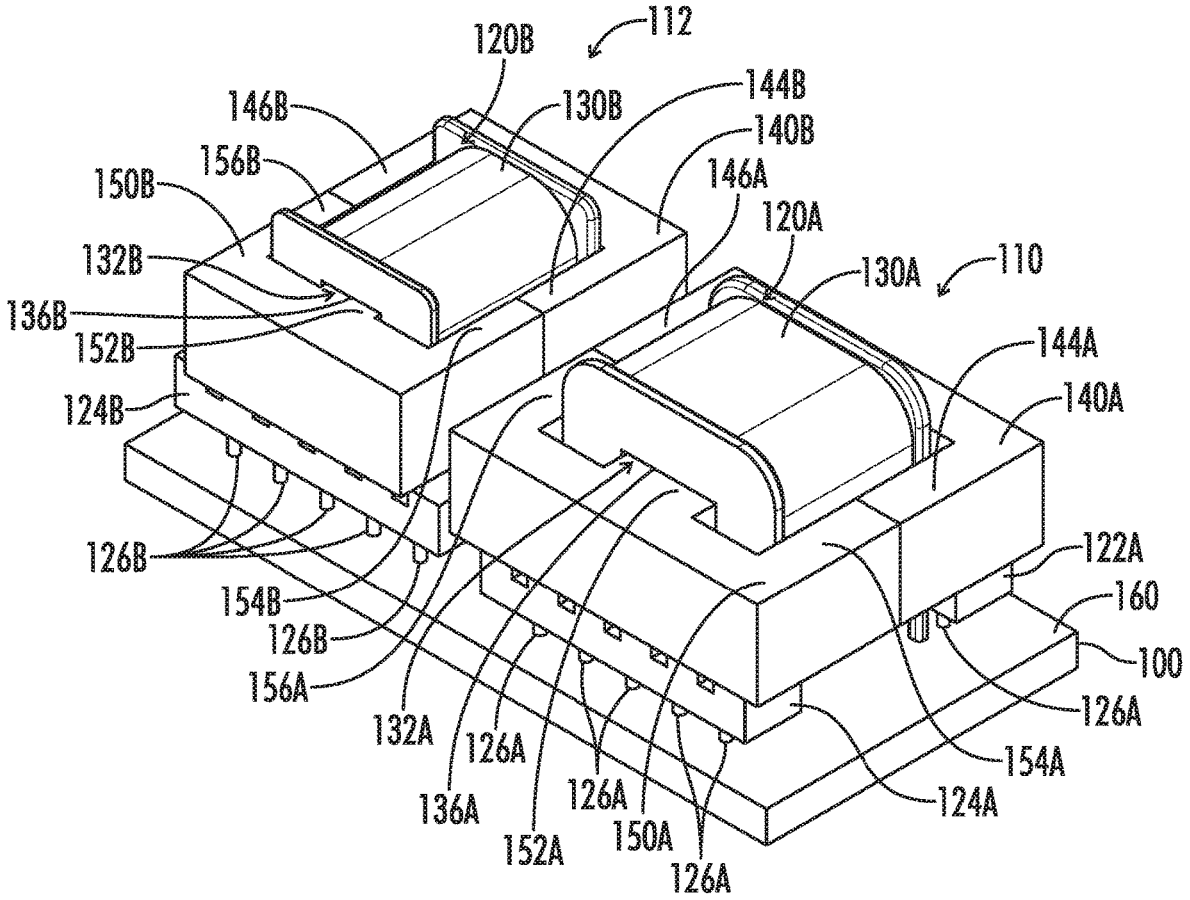
FIG. 1B (PRIOR ART)
FIG. 1B illustrates a lower rear perspective view of the printed circuit board and magnetic assemblies of FIG. 1A.
Figure 2:
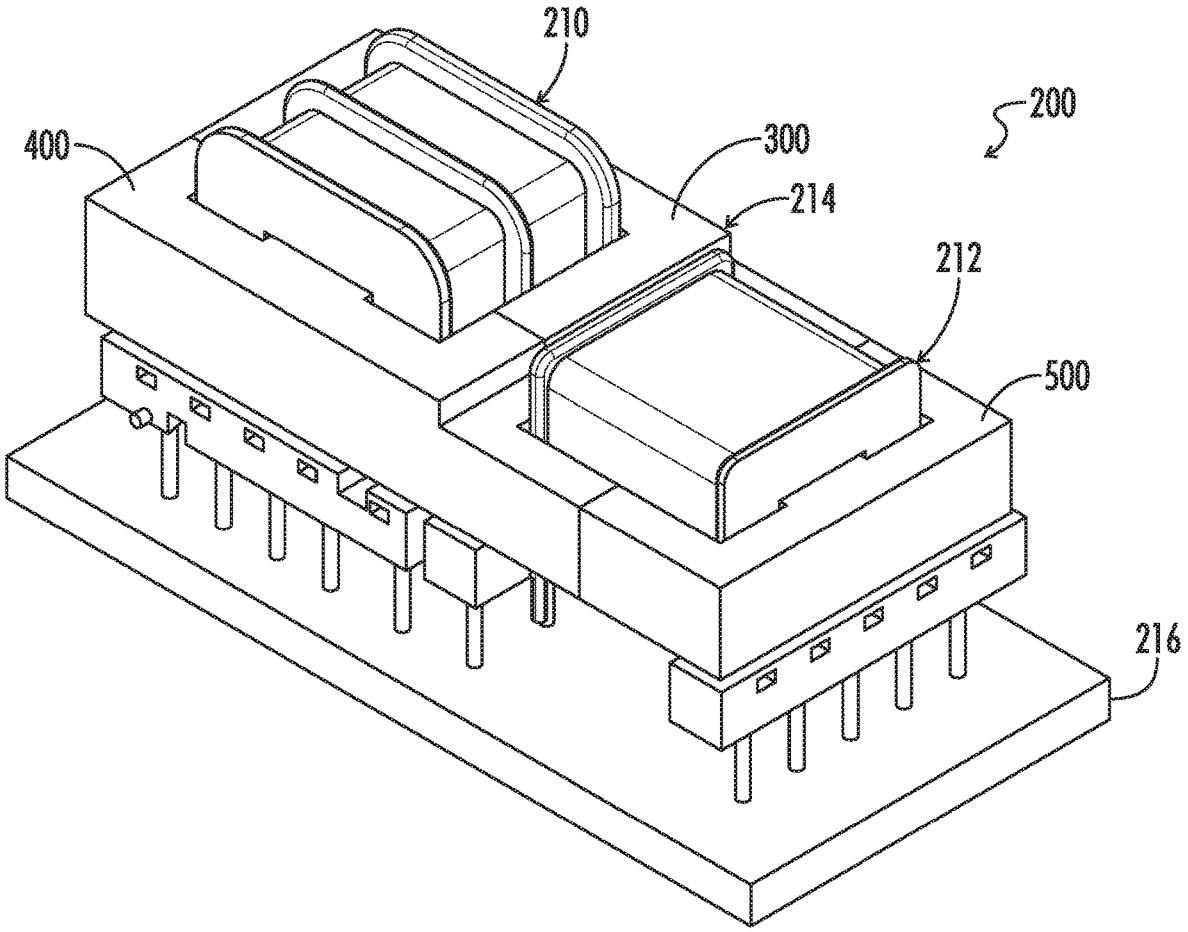
FIG. 2 illustrates an upper front perspective view of a single magnetic assembly mounted on a printed circuit board wherein the single magnetic assembly comprises two independent magnetic components positioned perpendicularly to each other and sharing a common core structure.
Figure 15:
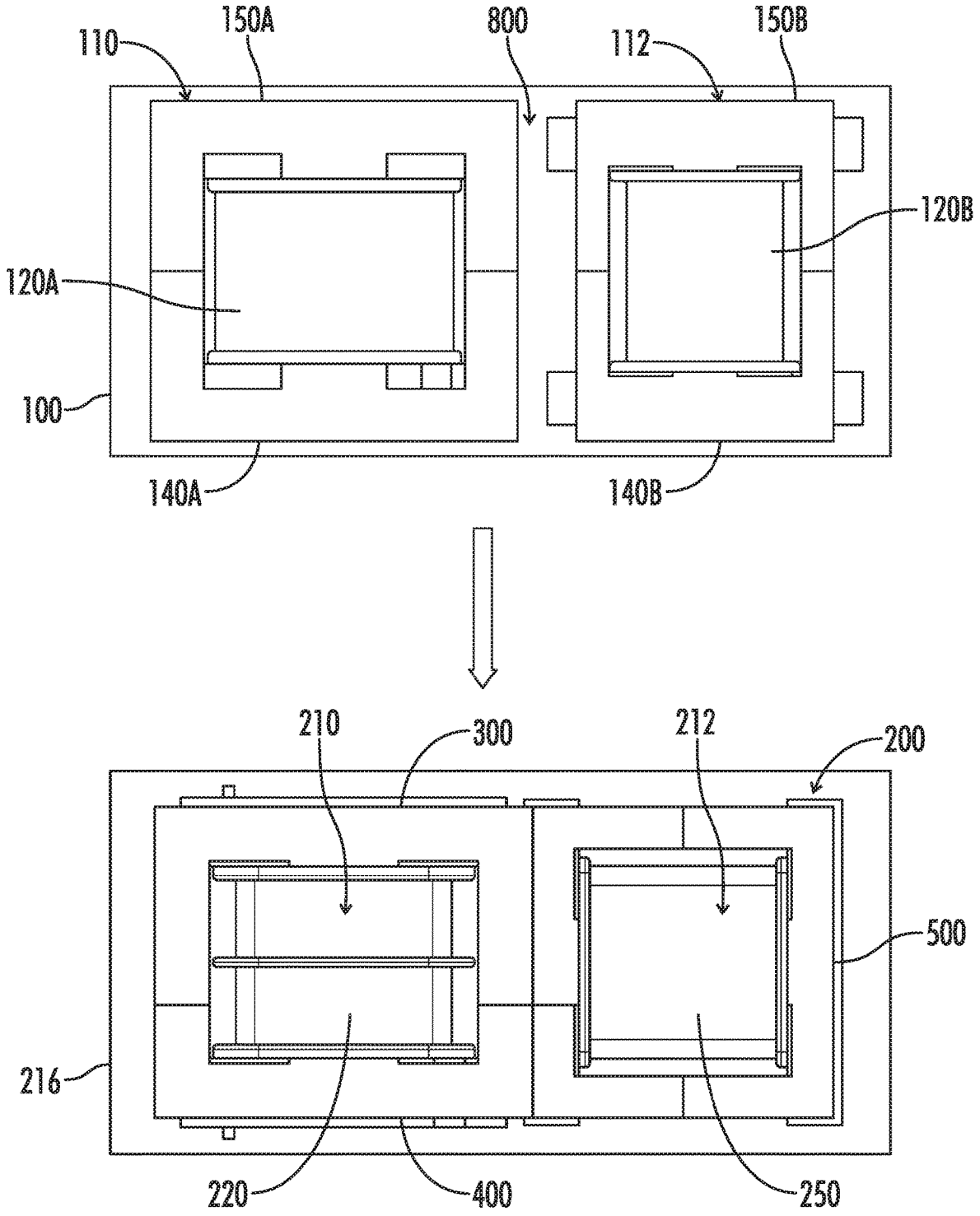
FIG. 15 pictorially compares the single magnetic assembly of FIG. 2 with the two separate magnetic assemblies of FIGS. 1A and 1B.

One benefit of the magnetic assembly 200 disclosed herein is illustrated pictorially in FIG. 15, which shows the first magnetic assembly 110 and the second magnetic assembly 112 of FIGS. 1A and 1B replaced with the single magnetic assembly 200 of FIG. 2. As illustrated, a structural gap 800 between the first magnetic assembly and the second magnetic assembly is eliminated by the improved single core structure. Furthermore, the new magnetic assembly rotates the second bobbin 250 ninety degrees relative to the first bobbin 220. Thus, the overall structure requires less area on a printed circuit board. By taking up less area on the printed circuit board, the new magnetic assembly increases power density. Furthermore, the installation steps are reduced by having to install only a single magnetic component instead of two separate magnetic components.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A magnetic core for use with a primary bobbin and an auxiliary bobbin, each bobbin having a respective passageway, the magnetic core comprising:

a first primary core portion having at least a first primary middle leg and a first auxiliary middle leg, the first primary middle leg configured to engage the passageway of the primary bobbin, the first auxiliary middle leg positioned perpendicularly to the first primary middle leg and configured to engage the passageway of the auxiliary bobbin;

a first primary core body of the first primary core portion extends in a first direction between a first end of the first primary core body and a second end of the first primary core body, the first primary core body having an outer surface and an inner surface;

a first primary outer leg of the first primary core portion extends perpendicularly from the inner surface of the first primary core body in a second direction perpendicular to the first direction, the first primary outer leg positioned proximate to the first end of the first primary core body, the first primary outer leg having a first primary outer leg end surface;

a second primary outer leg of the first primary core portion extends perpendicularly from the inner surface of the first primary core body in the second direction, the second primary outer leg positioned proximate to the second end of the first primary core body, the second primary outer leg having a second primary outer leg end surface;

the first primary middle leg of the first primary core portion extends perpendicularly from the inner surface of the first primary core body in the second direction, the first primary middle leg positioned between the first primary outer leg and the second primary outer leg, the first primary middle leg having a first primary middle leg cross-sectional profile configured to fit within the passageway of the primary bobbin, the first primary middle leg having a first primary middle leg end surface;

a first auxiliary core body of the first primary core portion extends in the second direction between the outer surface of the first primary core body and the end surface of the second primary outer leg, the first auxiliary core body having an inner surface facing the first direction;

a first auxiliary outer leg of the first primary core portion extends perpendicularly from the inner surface of the first auxiliary core body in the first direction, the first auxiliary outer leg positioned proximate the outer surface of the first primary core body, the first auxiliary outer leg having a first auxiliary outer leg end surface; and the first auxiliary middle leg of the first primary core portion extends perpendicularly from the inner surface of the first auxiliary core body in the first direction, the first auxiliary middle leg positioned proximate to the second primary outer leg end surface, the first auxiliary middle leg having a first auxiliary middle leg cross-sectional profile configured to fit within the passageway of the auxiliary bobbin, the first auxiliary middle leg having a first auxiliary middle leg end surface.

2. The magnetic core of claim 1, further comprising:

a second primary core portion having at least a second primary middle leg configured to engage the passageway of the primary bobbin; and an auxiliary core portion having at least a second auxiliary middle leg configured to engage the passageway of the auxiliary bobbin, the auxiliary core portion configured to mate with both the first and second primary core portions.

3. The magnetic core of claim 2, wherein:

a second primary core body of the second primary core portion extends in the first direction between a first end of the second primary core body and a second end of the second primary core body, the second primary core body having an outer surface and an inner surface;

a third primary outer leg of the second primary core portion extends perpendicularly from the inner surface of the second primary core body in a third direction, the third direction parallel to and opposite to the second direction, the third primary outer leg positioned proximate to the first end of the second primary core body, the third primary outer leg having a third primary outer leg end surface configured to abut the first primary outer leg end surface of the first primary core portion;

a fourth primary outer leg of the second primary core portion extends perpendicularly from the inner surface of the second primary core body in the third direction, the fourth primary outer leg positioned proximate to the second end of the second primary core body, the fourth primary outer leg having a fourth primary outer leg end surface configured to abut the second primary outer leg end surface of the first primary core portion;

the second primary middle leg of the second primary core portion extends perpendicularly from the inner surface of the second primary core body in the third direction, the second primary middle leg positioned between the third primary outer leg and the fourth primary outer leg, the second primary middle leg having a second primary middle leg cross-sectional profile configured to fit within the passageway of the primary bobbin, the second primary middle leg having a second primary middle leg end surface;

a second auxiliary core body of the second primary core portion extends in the third direction between the outer surface of the second primary core body and the end surface of the fourth primary outer leg, the second auxiliary core body having an inner surface facing the first direction; and a second auxiliary outer leg of the second primary core portion extends perpendicularly from the inner surface of the second auxiliary core body in the first direction, the second auxiliary outer leg positioned proximate the outer surface of the second primary core body, the second auxiliary outer leg having a second auxiliary outer leg end surface.

4. The magnetic core of claim 3, wherein:

a third auxiliary core body of the auxiliary core portion extends in the second direction between a first end of the third auxiliary core body and a second end of the third auxiliary core body, the third auxiliary core body having an outer surface and an inner surface;

a third auxiliary outer leg of the auxiliary core portion extends perpendicularly from the inner surface of the third auxiliary core body in a fourth direction, the fourth direction parallel to and opposite to the first direction, the third auxiliary outer leg positioned proximate to the first end of the third auxiliary core body, the third auxiliary outer leg having a third auxiliary outer leg end surface configured to abut the end surface of the first auxiliary outer leg of the first primary core portion;

a fourth auxiliary outer leg of the auxiliary core portion extends perpendicularly from the inner surface of the third auxiliary core body in the fourth direction, the fourth auxiliary outer leg positioned proximate to the second end of the third auxiliary core body, the fourth auxiliary outer leg having a fourth auxiliary outer leg end surface configured to abut the end surface of the second auxiliary outer leg of the second primary core portion; and the second auxiliary middle leg of the auxiliary core portion extends perpendicularly from the inner surface of the second auxiliary core body in the fourth direction, the second auxiliary middle leg positioned between the third auxiliary outer leg and the fourth auxiliary outer leg, the second auxiliary middle leg having a second auxiliary middle leg cross-sectional profile configured to fit within the passageway of the auxiliary bobbin, the second auxiliary middle leg having a second auxiliary middle leg end surface.

5. The magnetic core of claim 4, wherein a first gap is defined between the first primary middle leg end surface of the first primary core portion and the second primary middle leg end surface of the second primary core portion.

6. The magnetic core of claim 5, wherein:

the first and second primary outer legs have a common first primary length defined between the inner surface of the first primary core body and the first and second primary outer leg end surfaces, respectively;

the first primary middle leg has a second primary length defined between the inner surface of the first primary core body and the first primary middle leg end surface;

the third and fourth primary outer legs have a common third primary length defined between the inner surface of the second primary core body and the third and fourth primary outer leg end surfaces, respectively;

the second primary middle leg has a fourth primary length defined between the inner surface of the second primary core body and the second primary middle leg end surface; and the first gap is defined by a sum of:

a difference between the common first primary length and the second primary length; and a difference between the common third primary length and the fourth primary length.

7. The magnetic core of claim 6, wherein:

the second primary length is shorter than the common first primary length;

the fourth primary length is shorter than the common third primary length; and the common first primary length is longer than the common third primary length by a width of the first auxiliary middle leg of the first primary core portion.

8. The magnetic core of claim 5, wherein a second gap is defined between the first auxiliary middle leg end surface of the first primary core portion and the second auxiliary middle leg end surface of the auxiliary core portion.

9. The magnetic core of claim 8, wherein:

the first and second auxiliary outer legs have a common first auxiliary length defined between the inner surfaces of the first and second auxiliary core bodies, respectively, and the first and second auxiliary outer leg end surfaces, respectively;

the first auxiliary middle leg has a second auxiliary length defined between the inner surface of the first auxiliary core body and the first auxiliary middle leg end surface;

the third and fourth auxiliary outer legs have a common third auxiliary length defined between the inner surface of the third auxiliary core body and the third and fourth auxiliary outer leg end surfaces, respectively;

the second auxiliary middle leg has a fourth auxiliary length defined between the inner surface of the third auxiliary core body and the second auxiliary middle leg end surface; and the second gap is defined by a sum of:

a difference between the common first auxiliary length and the second auxiliary length; and a difference between the common third auxiliary length and the fourth auxiliary length.

10. A magnetic core having two independent magnetic components sharing a common core structure, the magnetic assembly comprising:

a first bobbin having a first winding surrounding a first passageway, the first passageway having a first passageway profile, the first passageway having a first end and a second end;

a second bobbin having a second winding surrounding a second passageway, the second passageway positioned perpendicularly to the first passageway, the second passageway having a second passageway profile, the second passageway having a first end and a second end; and a magnetic core assembly including at least a first core piece and at least a second core piece, at least the first core piece having at least a first primary middle leg and a first auxiliary middle leg, the first primary middle leg configured to engage the first end of the first passageway, the first auxiliary middle leg positioned perpendicularly to the first primary middle leg and configured to engage the first end of the second passageway;

a first primary core body of the first core piece extends in a first direction between a first end of the first primary core body and a second end of the first primary core body, the first primary core body having an outer surface, an inner surface, and a first primary core body cross-sectional area;

a first primary outer leg of the first core piece extends perpendicularly from the inner surface of the first primary core body in a second direction perpendicular to the first direction, the first primary outer leg positioned proximate to the first end of the first primary core body, the first primary outer leg having a first primary outer leg end surface and a first primary outer leg cross-sectional area;

a second primary outer leg of the first core piece extends perpendicularly from the inner surface of the first primary core body in the second direction, the second primary outer leg positioned proximate to the second end of the first primary core body, the second primary outer leg having a second primary outer leg end surface and a second primary outer leg cross-sectional area;

the first primary middle leg of the first core piece extends perpendicularly from the inner surface of the first primary core body in the second direction, the first primary middle leg positioned between the first primary outer leg and the second primary outer leg, the first primary middle leg having a first primary middle leg cross-sectional profile configured to fit within the passageway of the first bobbin, the first primary middle leg having a first primary middle leg end surface and a first primary middle leg cross-sectional area;

a first auxiliary core body of the first core piece extends in the second direction between the outer surface of the first primary core body and the end surface of the second primary outer leg, the first auxiliary core body having an inner surface facing the first direction, the first auxiliary core body having a first auxiliary core body cross-sectional area;

a first auxiliary outer leg of the first core piece extends perpendicularly from the inner surface of the first auxiliary core body in the first direction, the first auxiliary outer leg positioned proximate to the outer surface of the first primary core body, the first auxiliary outer leg having a first auxiliary outer leg end surface and a first auxiliary outer leg cross-sectional area; and the first auxiliary middle leg of the first core piece extends perpendicularly from the inner surface of the first auxiliary core body in the first direction, the first auxiliary middle leg positioned proximate to the end surface of the second primary outer leg, the first auxiliary middle leg having a first auxiliary middle leg cross-sectional profile configured to fit within the passageway of the second bobbin, the first auxiliary middle leg having a first auxiliary middle leg end surface and a first auxiliary middle leg cross-sectional area.

11. The magnetic core of claim 10, wherein:

the second core piece has at least a second primary middle leg configured to engage the second end of the first passageway of the first bobbin; and a third core piece of the magnetic core assembly has at least a second auxiliary middle leg configured to engage the second end of the second passageway.

12. The magnetic core of claim 11, wherein:

a second primary core body of the second core piece extends in the first direction between a first end of the second primary core body and a second end of the second primary core body, the second primary core body having an outer surface, an inner surface, and a second primary core body cross-sectional area;

a third primary outer leg of the second core piece extends perpendicularly from the inner surface of the second primary core body in a third direction, the third direction parallel to and opposite to the second direction, the third primary outer leg positioned proximate to the first end of the second primary core body, the third primary outer leg having a third primary outer leg end surface configured to abut the end surface of the first primary outer leg of the first core piece, the third primary outer leg having a third primary outer leg cross-sectional area;

a fourth primary outer leg of the second core piece extends perpendicularly from the inner surface of the second primary core body in the third direction, the fourth primary outer leg positioned proximate to the second end of the second primary core body, the fourth primary outer leg having a fourth primary outer leg end surface configured to abut the end surface of the second primary outer leg of the first core piece, the fourth primary outer leg having a fourth primary outer leg cross-sectional area;

the second primary middle leg of the second core piece extends perpendicularly from the inner surface of the second primary core body in the third direction, the second primary middle leg positioned between the third primary outer leg and the fourth primary outer leg, the second primary middle leg having a second primary middle leg cross-sectional profile configured to fit within the passageway of the first bobbin, the second primary middle leg having a second primary middle leg end surface and a second primary middle leg cross-sectional area;

a second auxiliary core body of the second core piece extends in the third direction between the outer surface of the second primary core body and the fourth primary outer leg end surface, the second auxiliary core body having an inner surface facing the first direction, the second auxiliary core body having a second auxiliary core body cross-sectional area; and a second auxiliary outer leg of the second core piece extends perpendicularly from the inner surface of the second auxiliary core body in the first direction, the second auxiliary outer leg positioned proximate the outer surface of the second primary core body, the second auxiliary outer leg having a second auxiliary outer leg end surface and a second auxiliary outer leg cross-sectional area.

13. The magnetic core of claim 12, wherein:

a third auxiliary core body of the third core piece extends in the second direction between a first end of the third auxiliary core body and a second end of the third auxiliary core body, the third auxiliary core body having an outer surface, an inner surface, and a third auxiliary core body cross-sectional area;

a third auxiliary outer leg of the third core piece extends perpendicularly from the inner surface of the third auxiliary core body in a fourth direction, the fourth direction parallel to and opposite to the first direction, the third auxiliary outer leg positioned proximate to the first end of the third auxiliary core body, the third auxiliary outer leg having a third auxiliary outer leg end surface configured to abut the end surface of the first auxiliary outer leg of the first core piece, the third auxiliary outer leg having a third auxiliary outer leg cross-sectional area;

a fourth auxiliary outer leg of the third core piece extends perpendicularly from the inner surface of the third auxiliary core body in the fourth direction, the fourth auxiliary outer leg positioned proximate to the second end of the third auxiliary core body, the fourth auxiliary outer leg having a fourth auxiliary outer leg end surface configured to abut the end surface of the second auxiliary outer leg of the second core piece, the fourth auxiliary outer leg having a fourth auxiliary outer leg cross-sectional area; and the second auxiliary middle leg of the third core piece extends perpendicularly from the inner surface of the second auxiliary core body in the fourth direction, the second auxiliary middle leg positioned between the third auxiliary outer leg and the fourth auxiliary outer leg, the second auxiliary middle leg having a second auxiliary middle leg cross-sectional profile configured to fit within the passageway of the second bobbin, the second auxiliary middle leg having a second auxiliary middle leg end surface and a second auxiliary middle leg cross-sectional area.

14. The magnetic core of claim 13, wherein:

the first primary core body cross-sectional area is at least as great as at least one of the first primary outer leg cross-sectional area and the second primary outer leg cross-sectional area;

the second primary core body cross-sectional area is at least as great as at least one of the third primary outer leg cross-sectional area and the fourth primary outer leg cross-sectional area;

the first auxiliary core body cross-sectional area is at least as great as the first auxiliary outer leg cross-sectional area;

the second auxiliary core body cross-sectional area is at least as great as the second auxiliary outer leg cross-sectional area; and the third auxiliary core body cross-sectional area is at least as great as at least one of the third auxiliary outer leg cross-sectional area and the fourth auxiliary outer leg cross-sectional area.

15. The magnetic core of claim 13, wherein:

the first primary middle leg cross-sectional area is at least as great as the sum of the first primary outer leg cross-sectional area and second primary outer leg cross-sectional area;

the second primary middle leg cross-sectional area is at least as great as the sum of the third primary outer leg cross-sectional area and fourth primary outer leg cross-sectional area;

the first auxiliary middle leg cross-sectional area is at least as great as the sum of the first auxiliary outer leg cross-sectional area and second auxiliary outer leg cross-sectional area; and the second auxiliary middle leg cross-sectional area is at least the sum of the third auxiliary outer leg cross-sectional area and fourth auxiliary outer leg cross-sectional area.

* * * * *